US012350554B2

(12) United States Patent
Hogge et al.

(10) Patent No.: US 12,350,554 B2
(45) Date of Patent: Jul. 8, 2025

(54) GOLF BALLS HAVING SIGHTING AID AND METHODS OF MAKING SAME

(71) Applicant: Acushnet Company, Fairhaven, MA (US)

(72) Inventors: Matthew Hogge, Plymouth, MA (US); Michael Madson, Easton, MA (US); Steven Aoyama, Marion, MA (US); Vincent Simonds, Brimfield, MA (US); Courtney Engle, Fall River, MA (US)

(73) Assignee: Acushnet Company, Fairhaven, MA (US)

( * ) Notice: Subject to any disclaimer, the term of this patent is extended or adjusted under 35 U.S.C. 154(b) by 554 days.

(21) Appl. No.: 17/862,876

(22) Filed: Jul. 12, 2022

(65) Prior Publication Data

US 2024/0017128 A1 Jan. 18, 2024

(51) Int. Cl.
*A63B 37/00* (2006.01)
*A63B 71/06* (2006.01)

(52) U.S. Cl.
CPC ..... *A63B 37/0022* (2013.01); *A63B 37/0074* (2013.01); *A63B 2071/0694* (2013.01)

(58) Field of Classification Search
CPC ..... A63B 37/0022; A63B 37/0074; A63B 2071/0694; A63B 43/008; A63B 45/02
USPC ..... 473/200, 220, 353, 268, 270, 280, 447
See application file for complete search history.

(56) References Cited

U.S. PATENT DOCUMENTS

| | | | | |
|---|---|---|---|---|
| 2,504,650 | A * | 4/1950 | Chessrown | A63B 43/00 428/11 |
| 4,546,975 | A * | 10/1985 | Nims | A63B 43/008 473/447 |
| 5,160,536 | A | 11/1992 | Harris et al. | |
| 6,013,330 | A | 1/2000 | Lutz | |
| 6,099,415 | A | 8/2000 | Lutz | |
| 6,248,804 | B1 | 6/2001 | Lutz | |
| 6,500,495 | B2 | 12/2002 | Lutz | |
| 6,739,980 | B2 * | 5/2004 | Scott | A63B 69/3632 473/270 |
| 6,935,240 | B2 | 8/2005 | Gosetti | |
| 8,627,768 | B2 * | 1/2014 | Smith | B43L 13/208 33/18.1 |
| D811,498 | S | 2/2018 | Finley et al. | |
| D811,499 | S | 2/2018 | Simonds et al. | |
| D814,578 | S | 4/2018 | Finley et al. | |
| D815,219 | S | 4/2018 | Simonds et al. | |
| 2007/0207874 | A1 * | 9/2007 | Klein | A63B 69/3655 473/280 |

* cited by examiner

*Primary Examiner* — Nini F Legesse
(74) *Attorney, Agent, or Firm* — Bradley Arant Boult Cummings LLP

(57) ABSTRACT

Sighting aids for golf balls that allow a golfer to sight a direction in which to hit or putt a golf ball and a method of producing the same and golf balls having sighting aids that have a certain degree of wrap determined by a sighting equation and surface coverage determine by a surface coverage equation.

19 Claims, 34 Drawing Sheets

GOLF BALLS HAVING SIGHTING AID AND METHODS OF MAKING SAME

FIELD OF THE INVENTION

The present disclosure relates generally to golf balls having sighting aids for guiding a golfer to sight a direction in which to hit or putt a golf ball and a method of producing the same. More particularly, the present disclosure relates to golf balls having sighting aids that have a degree of wrap (and thus a starting point and an ending point) determined by a sighting equation.

BACKGROUND OF THE INVENTION

The Rules of Golf are clear on objects used for alignment. From Rule 10-2b (2): "[The player or] caddie must not set an object down anywhere on or off the putting green to show your line of play." While there is a debate amongst some as to whether a marking on a golf ball or club is an object, aligning a golf ball with a line or other similar marking does not violate the Rules of Golf.

Since handmade lines are likely not durable with repeated use, manufacturers offer golf balls with printed alignment aids thereon. Such alignment aids generally consist of one or more continuous or non-continuous solid lines that extend partially around the circumference of the ball. For example, the alignment aid may extend pole to pole (or 180°) around the ball. The line is typically broken by the brand or sub-brand of the ball. In fact, some specialty companies offer personalized alignment aids where a solid line added to the ball may be broken with a moniker or name of choice inside the line. Other companies offer golf balls with symbols thereon, however, these symbols are merely ornamental and do not aid in aligning the golf ball. For example, U.S. Pat. Nos. D815,219, D814,578, D811,499 and D811,498 feature golf balls with symbols from a deck of cards repeating thereon.

Golfers wish to continually improve their game by seeking out ways to align a golf ball with the direction in which it should travel. In this vein, golfers often have difficulty properly aligning a golf ball along an intended direction of ball travel. If a club is properly aligned when it strikes a ball, it will generally follow the laws of physics and move in the direction it was struck. Thus, ball performance can be improved by improving the alignment of the ball relative to the targeted area and of the club with the ball.

Accordingly, there remains a need in the art for unique sightings aids and methods of determining the degree of wrap and surface coverage of such sighting aids to allow for more expansive options.

SUMMARY OF THE INVENTION

In one aspect, a golf ball includes a sighting aid disposed on the exterior surface of the golf ball. The sighting aid may include a continuous or discontinuous series of numbers, letters, symbols, or a combination thereof that extend along the perimeter of the golf ball (or a portion of the perimeter of the golf ball). The sighting aid provides an alignment reference on the golf ball for a golfer to align the sighting aid with at least one of an intended direction of travel of the golf ball and a club head used to strike the ball in the intended direction of travel.

The present disclosure relates to a golf ball having a sighting aid including a plurality of characters continuously extending at least partially around a perimeter of the golf ball according to Equation 1:

$$\text{Wrap} = \frac{N * W}{C} * 100 \tag{1}$$

wherein N is the number of characters in the plurality, W is the cell width, and C=circumference of the golf ball, and wherein the characters in the plurality include alphanumeric characters, punctuation, national characters, special characters, math symbols, emojis, Greek alphabet letters, or combinations thereof. In some embodiments, Wrap ranges about 10 percent and 100 percent. In other embodiments, Wrap is about 40 percent to about 60 percent.

In some aspects, the sighting aid may have a surface coverage according to Equation 2:

$$SC = \frac{H_{SA} * N * W}{A} * 100 \tag{2}$$

where $H_{SA}$ is the height of the sighting aid, N is the number of characters, W is the cell width, and A is the surface area of the golf ball. In one embodiment, SC is about 0.5 percent to about 25 percent. In another embodiment, SC is about 1 percent to about 4 percent. The golf ball may also optionally include a marking orthogonal to the sighting aid that is representative of the plurality of characters in the sighting aid.

The present disclosure is also directed to a golf ball having a sighting aid including a plurality of characters extending at least partially around a perimeter of the golf ball according to Equation 1:

$$\text{Wrap} = \frac{N * W}{C} * 100 \tag{1}$$

wherein N is the number of characters in the plurality, W is the cell width, and C=circumference of the golf ball. In some embodiments, Wrap ranges about 10 percent and 100 percent. In other embodiments, the sighting aid has a surface coverage according to Equation 2:

$$SC = \frac{H_{SA} * N * W}{A} * 100 \tag{2}$$

where $H_{SA}$ is the height of the sighting aid, N is the number of characters, W is the cell width, and A is the surface area of the golf ball. In some aspects, SC is about 0.5 percent to about 25 percent. In one embodiment, the characters in the plurality include alphanumeric characters, punctuation, national characters, special characters, math symbols, emojis, Greek alphabet letters, or combinations thereof. In another embodiment, the golf ball may include an inner subassembly and an outer layer disposed on the inner subassembly, wherein the sighting aid is applied to the outer layer. In yet another embodiment, the golf ball includes an inner subassembly and an outer layer disposed on the inner subassembly, wherein the outer layer is clear, and wherein the sighting aid is applied to the inner subassembly.

The present disclosure also relates to a golf ball including an inner subassembly; an outer layer disposed on the inner subassembly; and a sighting aid applied to one of the inner subassembly or outer layer, wherein the sighting aid includes a plurality of characters extending at least partially around a perimeter of the golf ball according to Equation 1:

$$\text{Wrap} = \frac{N * W}{C} * 100 \quad (1)$$

wherein N is the number of characters in the plurality, W is the cell width, and C=circumference of golf ball, and wherein the sighting aid has a surface coverage according to Equation 2:

$$SC = \frac{H_{SA} * N * W}{A} * 100 \quad (2)$$

where $H_{SA}$ is the height of the sighting aid and A is the surface area of the golf ball. In one embodiment, the characters in the plurality include alphanumeric characters, punctuation, national characters, special characters, math symbols, emojis, Greek alphabet letters, or combinations thereof. In another embodiment, SC is about 0.5 percent to about 25 percent. In still another embodiment, Wrap ranges about 10 percent and 100 percent. In yet another embodiment, the golf ball further includes a marking orthogonal to the sighting aid that is representative of the plurality of characters in the sighting aid.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The terms "first," "second," "third," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

The term "character" is used herein to describe alphanumeric characters including alphabetic characters A-Z (upper and lower case), numeric characters (0-9), and any combination thereof), national characters, special characters, math symbols, punctuation, math symbols, emojis, Greek alphabet letters, and combinations thereof.

The terms "sighting aid" or "alignment aid," as used herein, refers to any visible continuous or non-continuous marking on the golf ball useful for a golfer to align the sighting aid with at least one of an intended direction of travel of the golf ball and a club head used to strike the ball in the intended direction of travel.

Sighting Aid

Figure 1A:
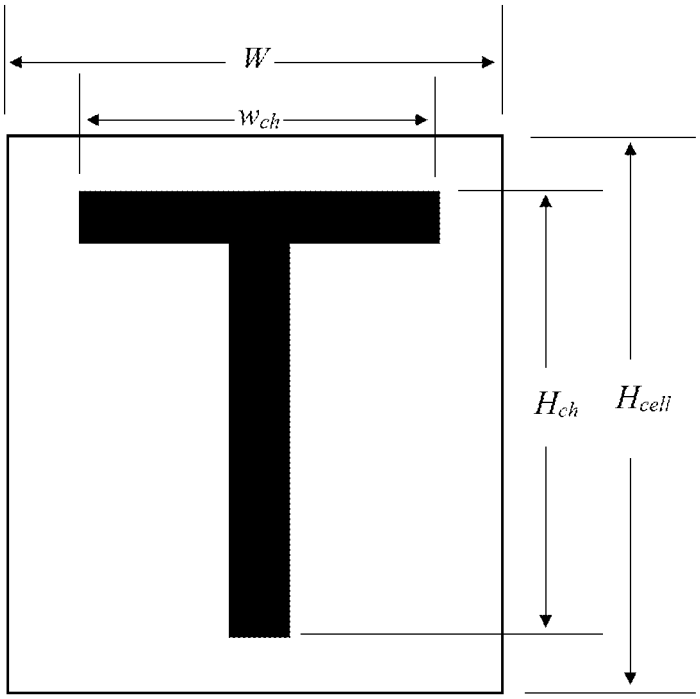
FIG. 1A illustrates an individual cell in a sighting aid in accordance with an embodiment of the present disclosure.

The present disclosure contemplates a golf ball with a sighting aid marked or formed thereon where the sighting aid extends around the golf ball as a percentage of the total circumference (Wrap) according to equation (1) below:

$$\text{Wrap} = \frac{N * W}{C} * 100 \quad (1)$$

where N is the number of characters in the sighting aid, W is the cell width as explained below and illustrated in FIG. 1A, and C=circumference of the golf ball (2πr where r is the radius of the golf ball).

The cell width is generally representative of the character size, but may also include padding on the left and right sides. For example, as shown in FIG. 1A, the cell width (W) may be slightly wider than the actual width of the character ($w_c$). In some embodiments, the number of characters in the sighting aid may be determined based on the desired font and font size. In other embodiments, the sighting aid, font, and/or font size may be determined based on the desired Wrap. For example, if the sighting aid should wrap 180° around the golf ball, using equation (1) above, $$N*W=0.5*C$$

and the number of characters and point size, i.e., the sighting aid parameters, may be determined with a known golf ball diameter. For example, if the sighting aid is a series of numbers that could vary, e.g., the number π is a mathematical constant that is approximately equal to 3.14159, but is sometimes displayed with 10 digits, 20 digits, 100 digits, and more. To the extent that the number π is used as the sighting aid, the number of digits or characters that are used may be determined based on the desired amount of Wrap.

In some embodiments, Wrap is between about 10 percent and 100 percent. In this aspect, Wrap may be about 20 percent to about 80 percent. In some embodiments, Wrap is about 30 percent to about 70 percent. In other embodiments, Wrap is about 40 percent to about 60 percent. In still other embodiments, Wrap is about 45 percent to about 55 percent.

The sighting aid may have a surface coverage (as a percentage of the total surface area of the golf ball) (SC) according to equation (2) below:

$$SC = \frac{H_{SA} * N * W}{A} * 100 \quad (2)$$

where $H_{SA}$ is the height of the sighting aid, N is the number of characters, W is the cell width, and A is the surface area of the golf ball. In some embodiments, SC is about 0.5 percent to about 25 percent. In this aspect, SC may be about 0.75 percent to about 5 percent. In other aspects, SC may be about 1 percent to about 4 percent. In still other aspects, SC may be about 1 percent to about 3 percent. In still other embodiments, SC is about 10 percent to about 25 percent. For example, SC may be about 15 percent to about 25 percent.

Figure 1B:
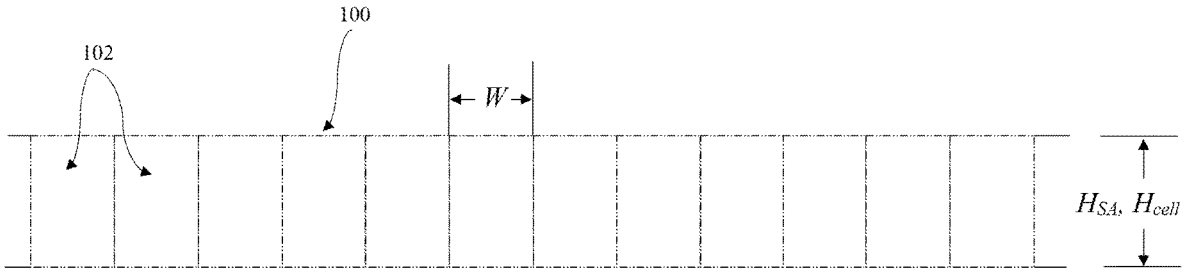
FIGS. 1B and 1C illustrate sighting aids or portions thereof in accordance with embodiments of the present disclosure.
Figure 1C:
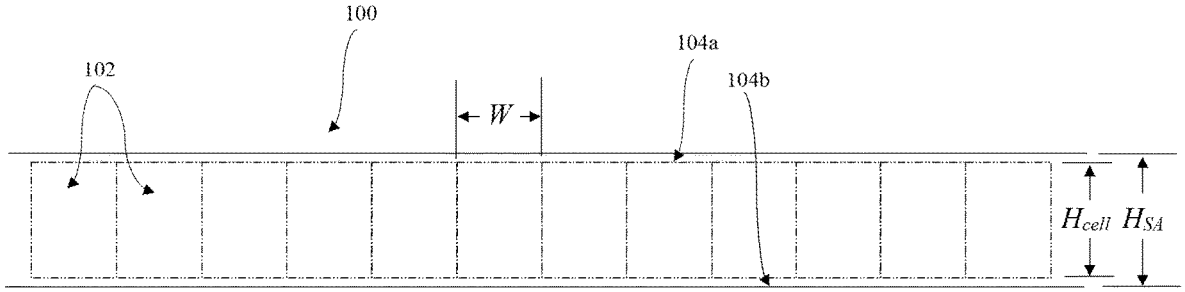
Figure 2:
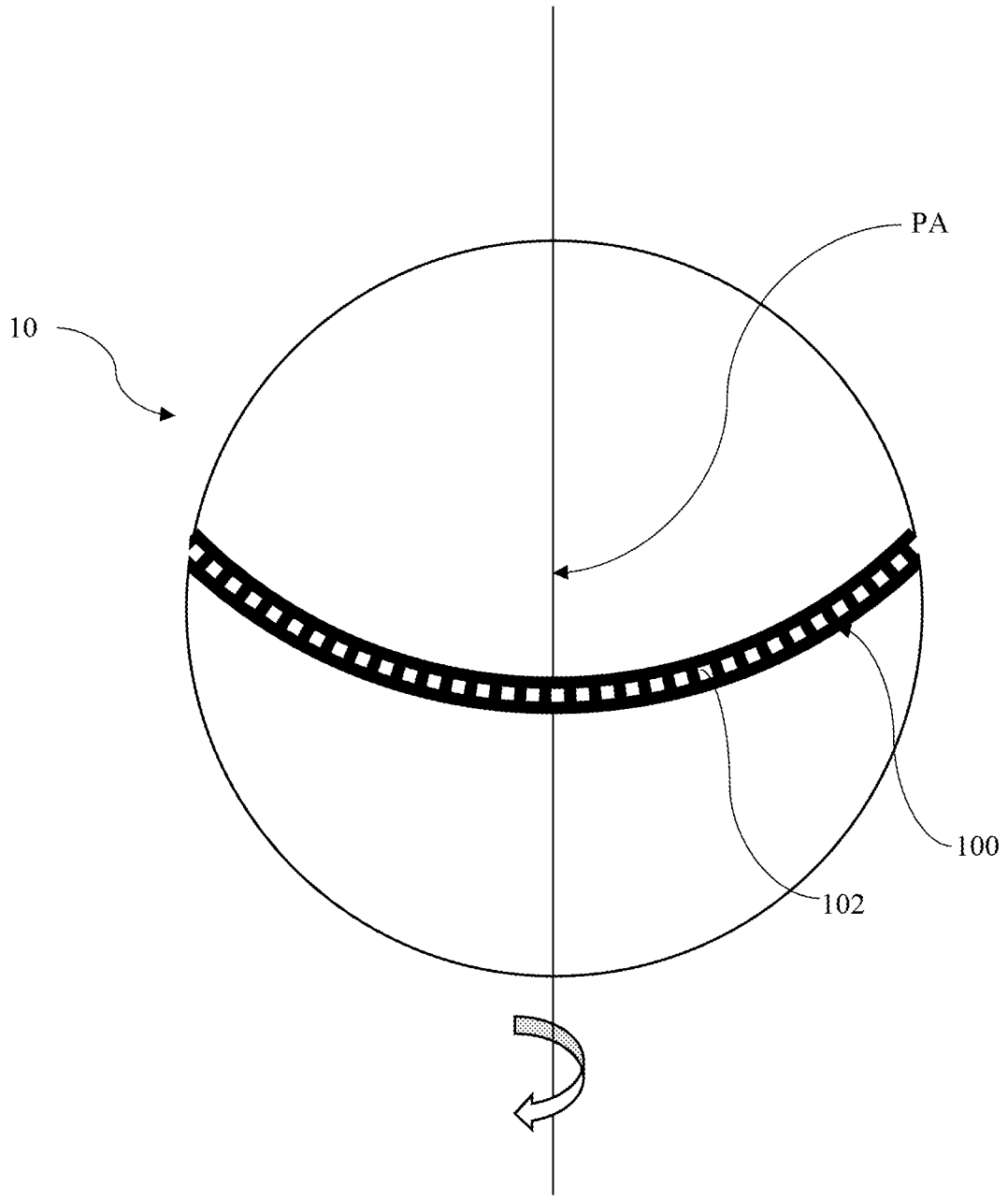
FIG. 2 is a front view of a golf ball having a sighting aid in accordance with an embodiment of the present disclosure.

As shown in FIGS. 1B and 1C, the sighting aid may have a height $H_{SA}$ that is representative of the cell height ($H_{cell}$) or larger than the cell height, i.e., $H_{SA}>H_{cell}$. The cell height $H_{cell}$ is generally the point size of the characters, which is different than the actual height of the individual characters ($H_{ch}$) as shown in FIG. 1A. For example, as shown in FIG. 1B, the sighting aid 100 has a height $H_{SA}$ that is the same or substantially the same as the height of the cells 102 ($H_{cell}$). As shown in FIG. 1C, the height of the sighting aid 100 is greater than the cell height, i.e., $H_{SA}>H_{cell}$, owing to the padding on the top and bottom (104*a*, 104*b*) of the sighting aid. This aspect might be useful when the sighting aid is a solid bar with the characters in a contrast color, e.g., black background, white or light characters, as generally illustrated in FIG. 2. In this aspect, $H_{SA}$ is determined by the following:

$$H_{SA}=\text{padding top}+H_{cell}+\text{padding bottom}$$

Padding top and padding bottom can be zero as discussed with respect to FIG. 1B. In other embodiments, padding top and padding bottom may be the same or different. In still other embodiments, each of the padding top and padding bottom may be determined as a percentage of $H_{SA}$. For instance, each of the padding top and padding bottom may account for about 1 percent to about 25 percent of $H_{SA}$. In one embodiment, each of the padding top and padding bottom accounts for about 5 percent to about 20 percent of $H_{SA}$.

Figure 3:
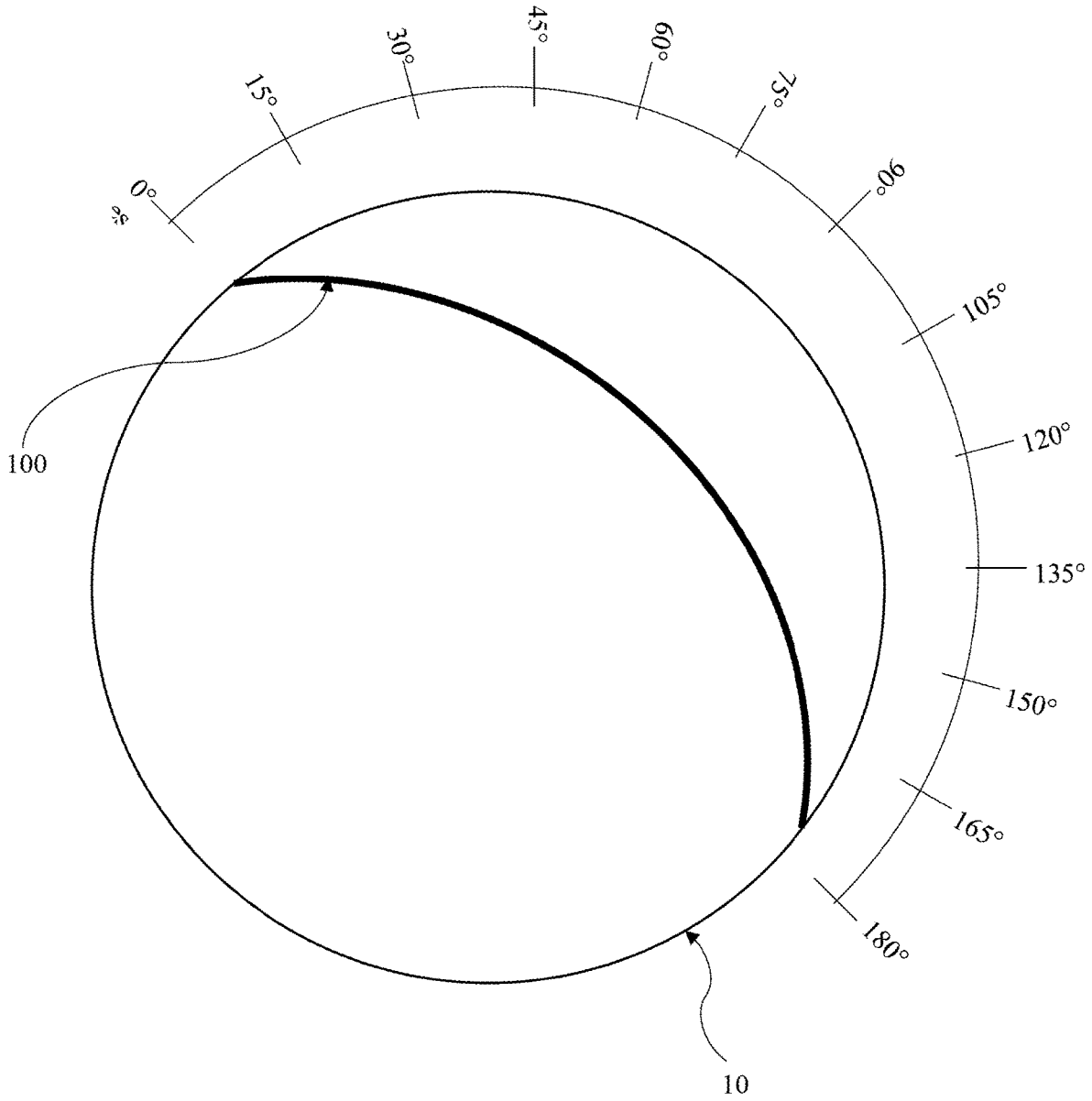
FIG. 3 is a perspective view of a golf ball having a sighting aid in accordance with an embodiment of the present disclosure.

Although the sighting aid 100 is shown in FIGS. 2 and 3 as extending continuously around at least a portion the circumference of the golf ball 10, this is not absolutely necessary since the sighting aid 100 may extend continuously only a portion of the circumference of the golf ball. In some embodiments (not shown), the sighting line may extend discontinuously around the entirety of the circumference or only a portion of the circumference of the golf ball. In one embodiment, the discontinuous nature of the sighting aid is accomplished with positioning characters in the sighting aid that are blank. In this regard, the amount of discontinuity can be determined using the known width of the cell or the width of the cell can determine the amount of the discontinuity. In another embodiment, the discontinuous nature of the sighting aid is the result of a plurality of sighting aids. For example, the sighting aid may actually be at least two sighting aids with a predetermined amount of discontinuity therebetween.

The sighting aid may include alphanumeric characters. The alphanumeric characters may include Latin letters, Arabic numbers, and combinations thereof. In one embodiment, the sighting aid includes any one of the alphanumeric characters 0-9, the alphabetic characters A-Z (both capital and lowercase), and combinations thereof. In one aspect, the sighting aid includes both alphanumeric letters and numbers.

The sighting aid may also include punctuation, national characters, special characters, math symbols, emojis, and combinations thereof. Non-limiting examples of punctuation include a period (.), a comma (,), a colon (:), a semicolon (;), a question mark (?), a hyphen (-), an exclamation mark (!), a single quotation mark (‘), a double quotation mark (“), an apostrophe (’), an ellipsis ( . . . ), a slash (/), and combinations thereof. Non-limiting examples of national characters include @, #, $, and combinations thereof. Non-limiting examples of special characters include an ampersand (&), an asterisk (*), a blank, braces ({ }), brackets ([ ]), parenthesis (( )), a back slash (\), a copyright symbol (©), a registered trademark symbol (®), a trademark symbol (™) a section symbol (§), and combinations thereof. Non-limiting examples of math symbols include an equal sign (=), a not equal sign (≠), strict inequality (< or >), inequality (≤ or ≥), minus sign (−), plus sign (+), plus or minus sign (±), times sign (×), obelus (÷), square root (√), an infinity sign (∞), and combinations thereof. In one aspect, the sighting aid may include one or more blank spaces, which may be useful to create a discontinuous sighting aid.

The sighting aid may also include letters from the Greek alphabet letters. In one aspect, the sighting aid includes both alphanumeric letters and/or numbers and Greek alphabet letters.

Nonlimiting examples of unique identifiers, equations, constants, mathematical sets, functions, and the like that may be used as the basis for forming sighting aids in accordance with the present disclosure include Pi (π), the golden ratio (φ), Tau (τ), Euler's number (e), Avogadro's number ($N_A$), Feigenbaum's constant (δ), Euler's constant (γ), Planck's constant (h), √5, √2, a Fibonacci sequence, and Bessel functions.

Methods of Applying the Sighting Aid

The sighting aid may be applied in a variety of ways including ink jet printing, LED UV printing, pad printing, and combinations thereof. In this aspect, a golf ball or golf ball subassembly may be loaded into a printing station for application of the sighting aid. In this regard, neither the method of application (including the curing, if applicable) nor the ink used to apply the sighting aid is subject to any particular limitation. In some embodiments, the ink is suitable for application with an ink jet process. In other embodiments, the ink is suitable for use with a laser printing process. In still other embodiments, the sighting aid is applied using an ultraviolet radiation-curable ink and method such as disclosed in U.S. Pat. Nos. 6,013,330 and 6,099,415 and 6,500,495, 6,248,804, and 6,099,415, the entire disclosures of which are incorporated by reference herein. In yet other embodiments, the ink is a sublimating ink such as the ink disclosed in U.S. Pat. No. 6,935,240, the entire disclosure of which is incorporated by reference herein. In other embodiments, the sighting aid is applied using the ink and method disclosed in U.S. Pat. No. 5,160,536, which is incorporated by reference herein in its entirety.

In one embodiment, the sighting aid may be applied by pad printing. In this aspect, one or more pad printing stations may be used to apply the sighting aid to the golf ball. In some embodiments, the printing system includes at least one pad printing station. The number of pad printing stations may vary depending on the sighting aid(s) or other markings to be printed on the golf ball. In this regard, each pad printing station utilizes an etched image plate having a negative etching of the desired sighting aid. The etchings within the image plates are filled with ink for printing the sighting aid onto the exterior surface of the golf ball or golf ball subassembly. The ink released from the printing pad forms, on the spherical surface of the ball or ball subassembly, an image corresponding to that of the etched cavity on the image plate. In some embodiments, the step of applying the sighting aid onto the surface of the golf ball may be repeated at least twice to the same area of the surface of the golf ball with the same sighting aid. For instance, the sighting aid can be formed from a first pad print hit that applies a first ink layer followed by a second pad print hit that applies a second ink layer to the same area of the surface of the golf ball. In other embodiments, the step of applying the sighting aid onto the surface of the golf ball may be repeated at least three times to the same area of the surface of the golf ball with the same sighting aid. For example, the sighting aid can be formed from a first pad print hit that applies a first ink layer followed by a second pad print hit that applies a second ink layer followed by a third pad print hit that applies a third ink layer to the same area of the surface of the golf ball.

One or more drying stations for drying the sighting aid and/or printed areas of the golf ball may also be used. For example, after the sighting aid is applied to the desired portion of the surface of the golf ball, the method includes a step for drying the sighting aid printed on the surface of the golf ball. In some embodiments, the sighting aid may be dried by using forced ambient air or heated air. The heated air may have a temperature of about 60° F. or greater. For example, the heated air applied to the sighting aid may have a temperature of about 80° F. or greater. In other embodiments, the sighting aid may be dried using forced air that is a by-product of cooling a UV-curable light source.

The golf ball may be rotated along the primary axis (PA) for printing on another portion of the surface of the ball. For example, the golf ball may be rotated along the primary axis to expose the unprinted portion of the ball to receive the remainder of the sighting aid without substantially moving the center of the golf ball. The degree of rotation may vary depending on the desired length of the sighting aid. In some embodiments, the degree of rotation may range from about 10 degrees to about 180 degrees. In other embodiments, the degree of rotation may range from about degrees to about 120 degrees. In still other embodiments, the degree of rotation may range from about 60 degrees to about 90 degrees.

After the golf ball is rotated, the golf ball is again subjected to further printing. The drying, reorientation, and printing steps can be repeated until the entirety of the sighting aid is printed. For instance, in some embodiments, a manufacturer may desire a sighting aid that is printed around the primary axis at least about 90°. In another embodiment, the sighting aid extends around the primary axis at least about 120°. In still another embodiment, the sighting aid extends around the primary axis at least about 180°.

In some embodiments, the golf ball may be reoriented and undergo two printing steps such that at least two surface portions of the golf ball are printed. For example, if the sighting aid is associated with a name or symbol, e.g., the Pi number is associated with the Greek letter 7C, the golf ball may also include this symbol in another area of the ball. In this aspect, the name or symbol associated with the sighting aid may replace the typical play number that appears on the ball. These unique "play numbers" may be orthogonal to the sighting aid. In other embodiments, the golf ball may be reoriented and undergo at least three printing steps such that at least three surface portions of the golf ball are printed. In still other embodiments, the golf ball may be reoriented and undergo four or more printing steps such that at least four surface portions of the golf ball are printed.

As briefly discussed above, when the method of application of the sighting aid and/or particular ink used to apply the sighting aid require curing, the curing step or steps depend on the type of ink used. In this regard, it is contemplated that a variety of curing methods may be used in accordance with the invention including, but not limited to, ultraviolet radiation, thermal, e-beam, and combinations thereof.

In one embodiment, more than one sighting aid is applied to the ball. For example, a golf ball made in accordance with the present disclosure may include two or more sighting aids, where the sighting aids may be the same or different (in type and number of characters) and may be parallel or orthogonal to one another.

Once the desired sighting aid is printed on the exterior surface, the method may optionally include applying an additional structural layer(s) (when the sighting aid is printed on the exterior surface of an inner ball) or coating layer, such as an adhesion-promoting coating layer, to the printed golf ball to improve adhesion of any topcoat(s). In some embodiments, a urethane topcoat is applied over the exterior surface of the golf ball after the sighting aid and any other markings are applied. The urethane topcoat may be water-based or solvent-based.

The methods of the present disclosure may optionally include a step for inspecting the golf ball after the sighting aid has been applied to the surface. The inspecting step may include analyzing the sighting aid to determine whether it is within predetermined acceptable parameters. Using an inspection step allows for constant monitoring of the printed golf balls, in-line with the printing stations, so that early signs of undesirable printing conditions can be attended. In this aspect, the printing system may include one or more automated inspection systems and imaging systems configured to analyze various characteristics of the sighting aid, including its cosmetic or aesthetic appearance on the golf ball and the accuracy in which the mark is applied.

Figure 4:
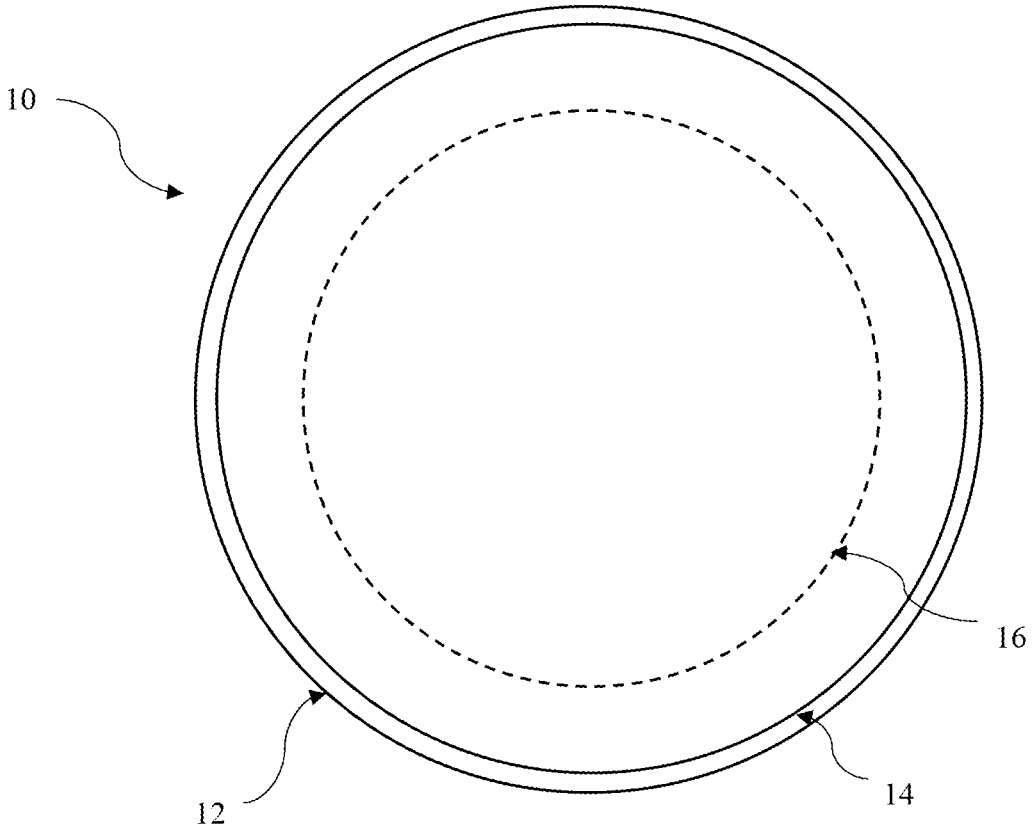
FIG. 4 is a cross-section of a golf ball suitable for use with the present invention.
Figure 5A:
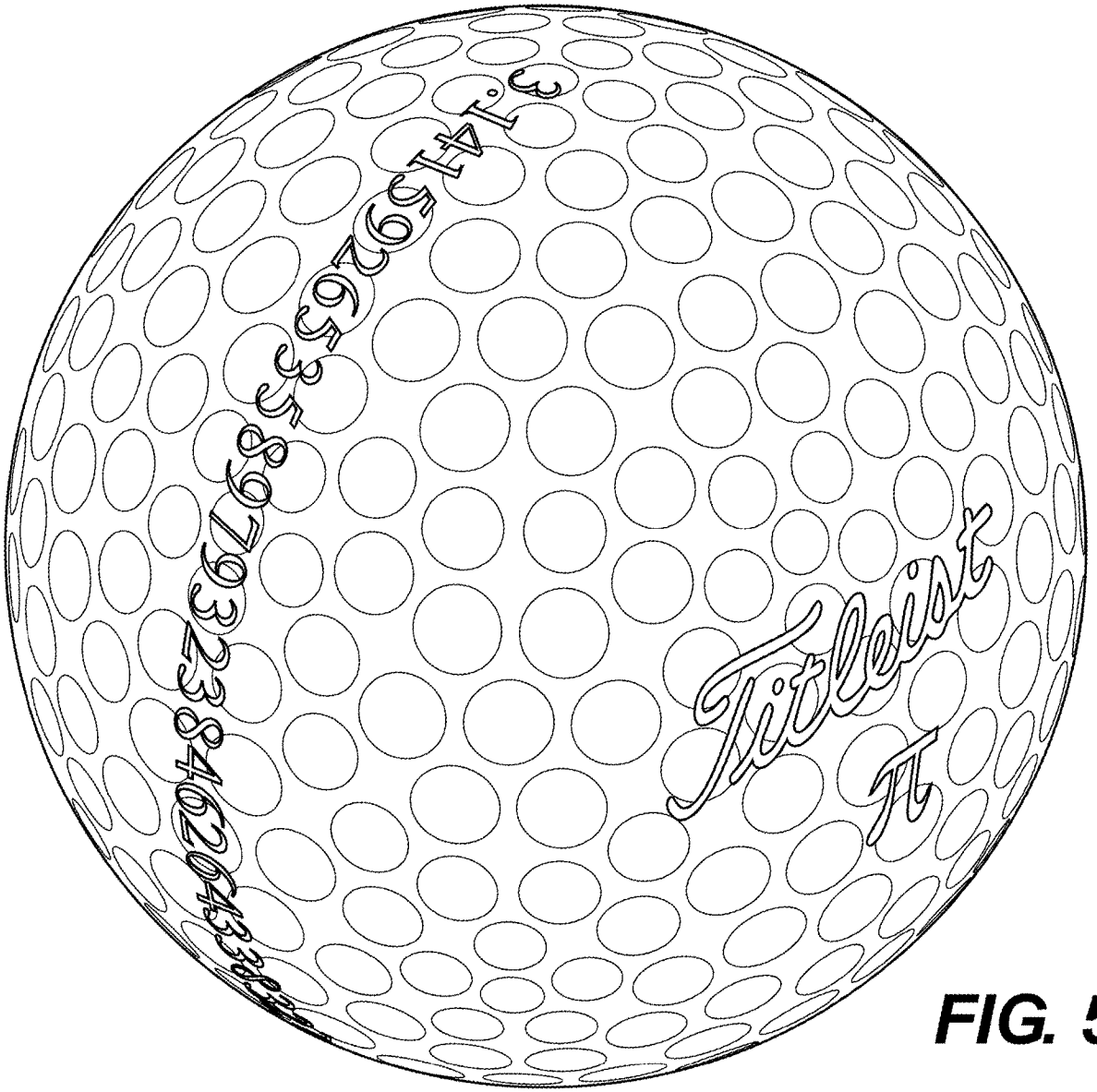
FIGS. 5A-5G are examples of golf balls with sighting aids according to an embodiment of the invention.
Figure 5B:
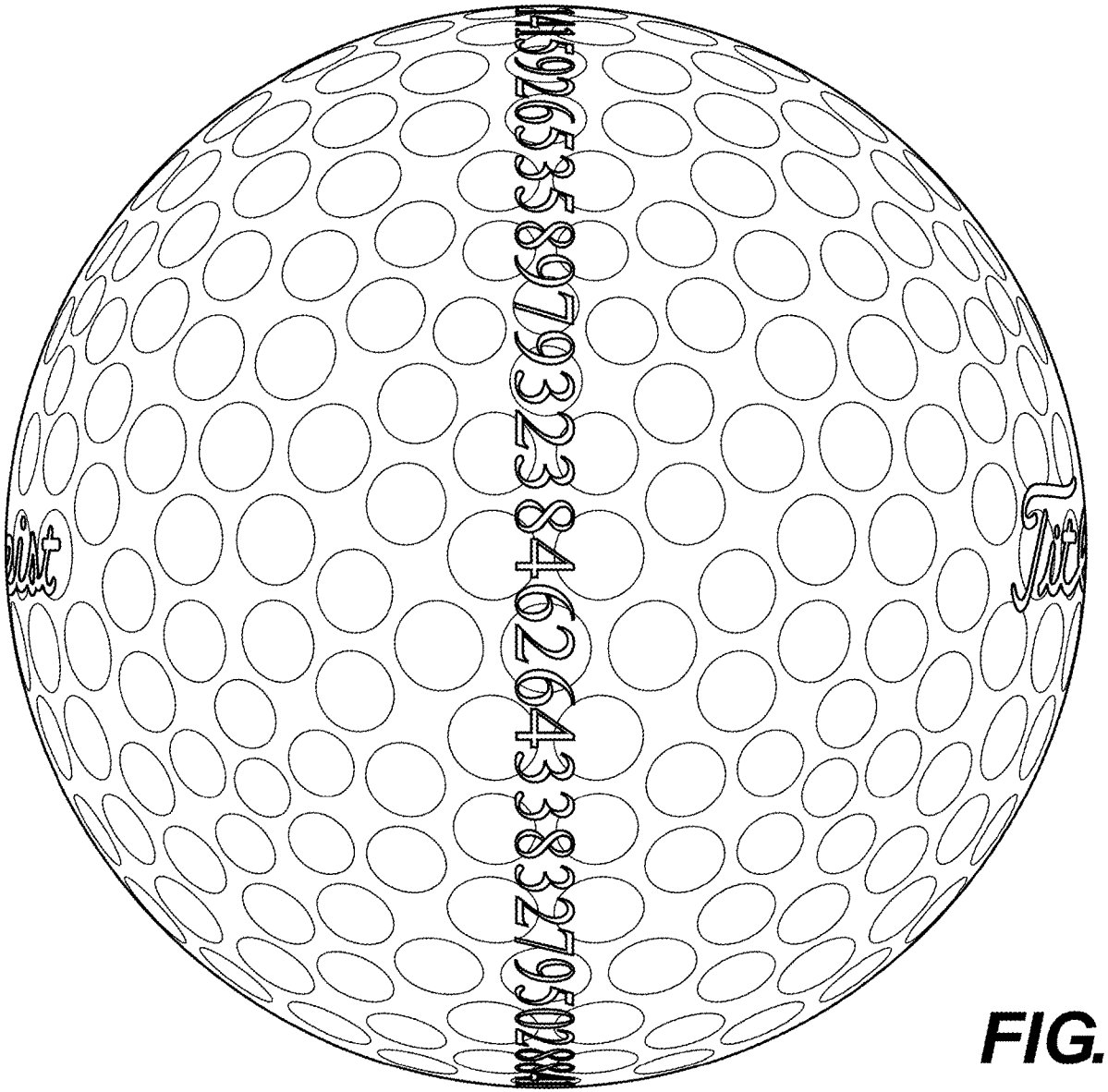
Figure 5C:
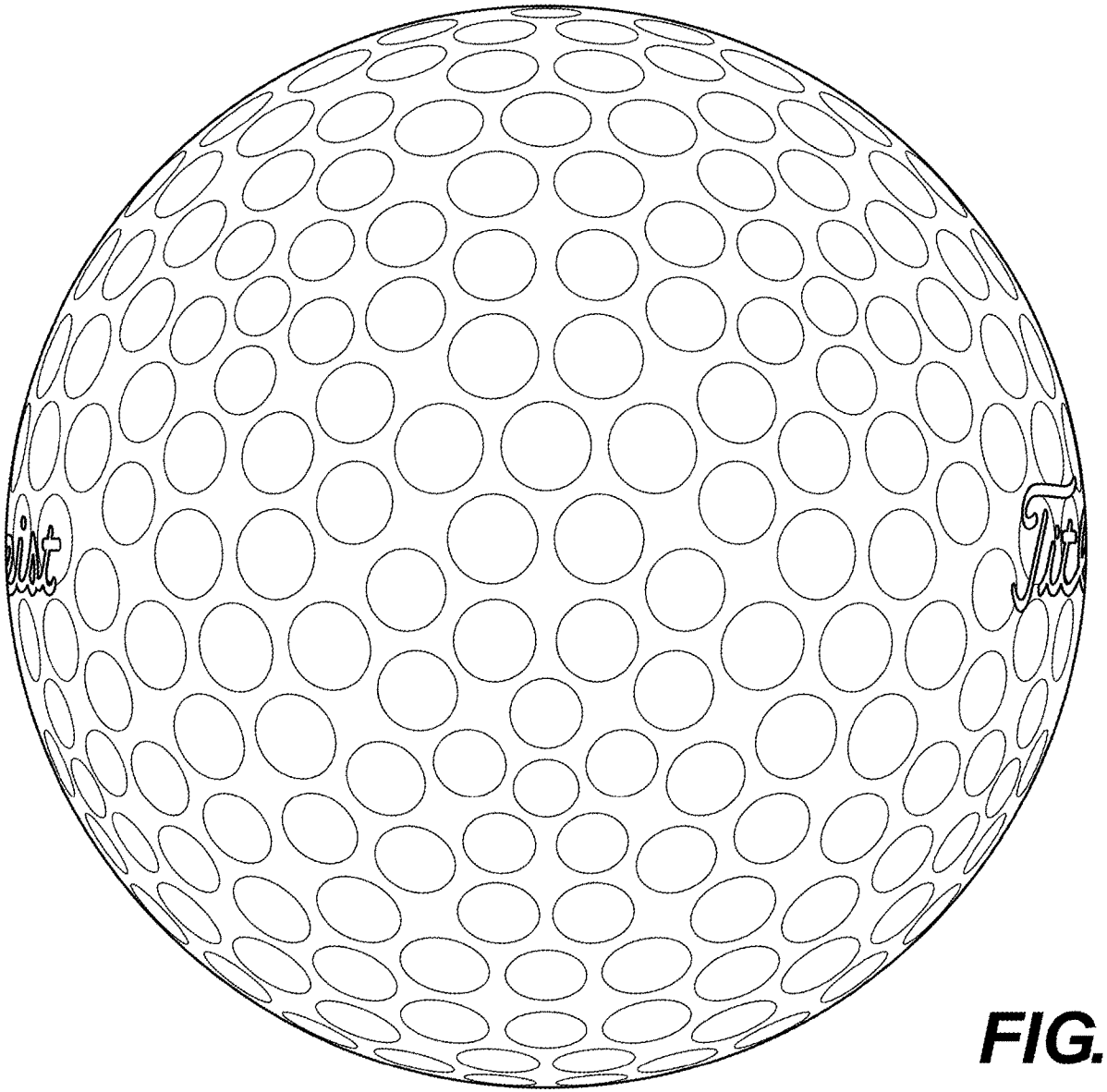
Figure 5D:
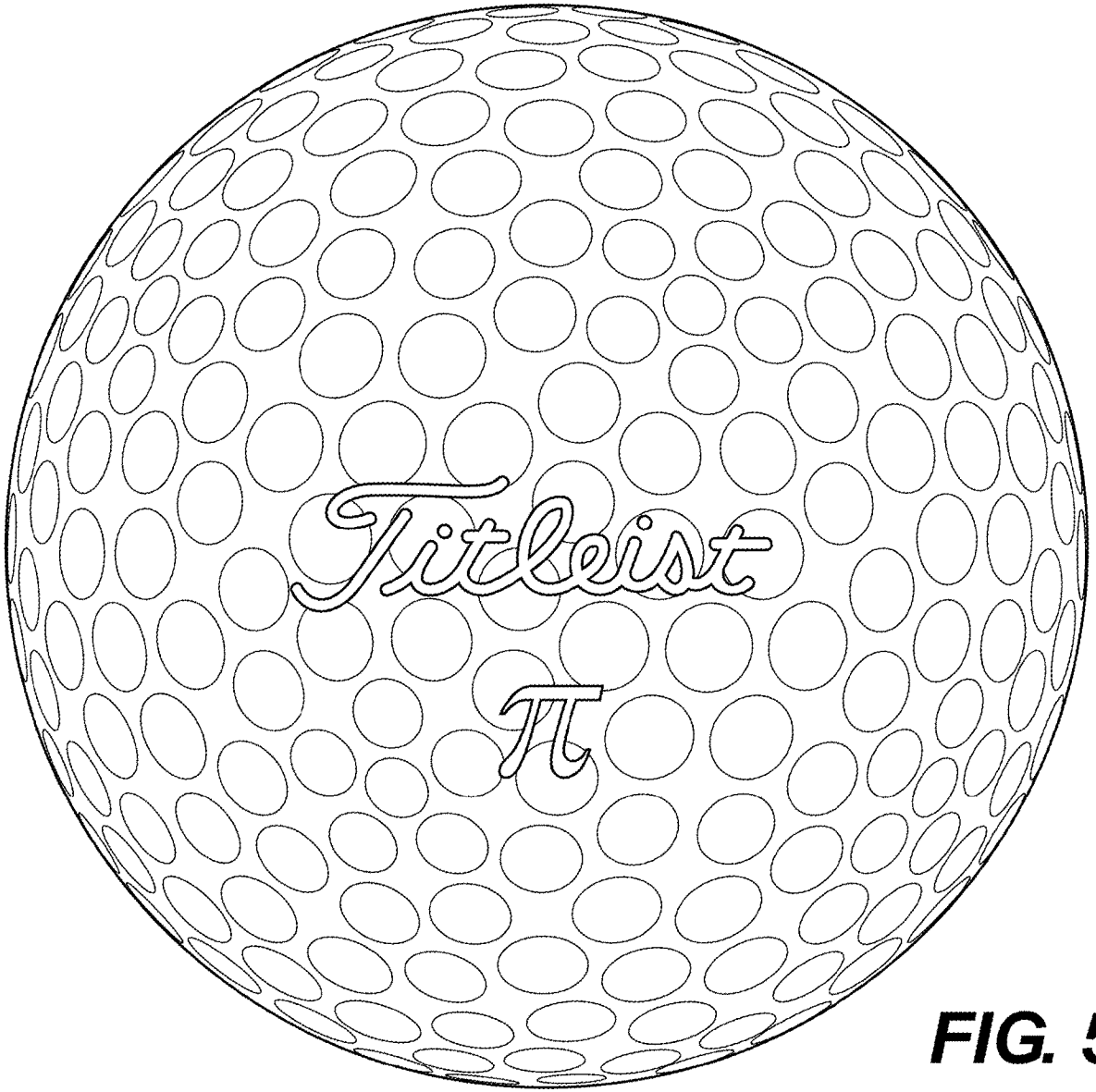
Figure 5E:
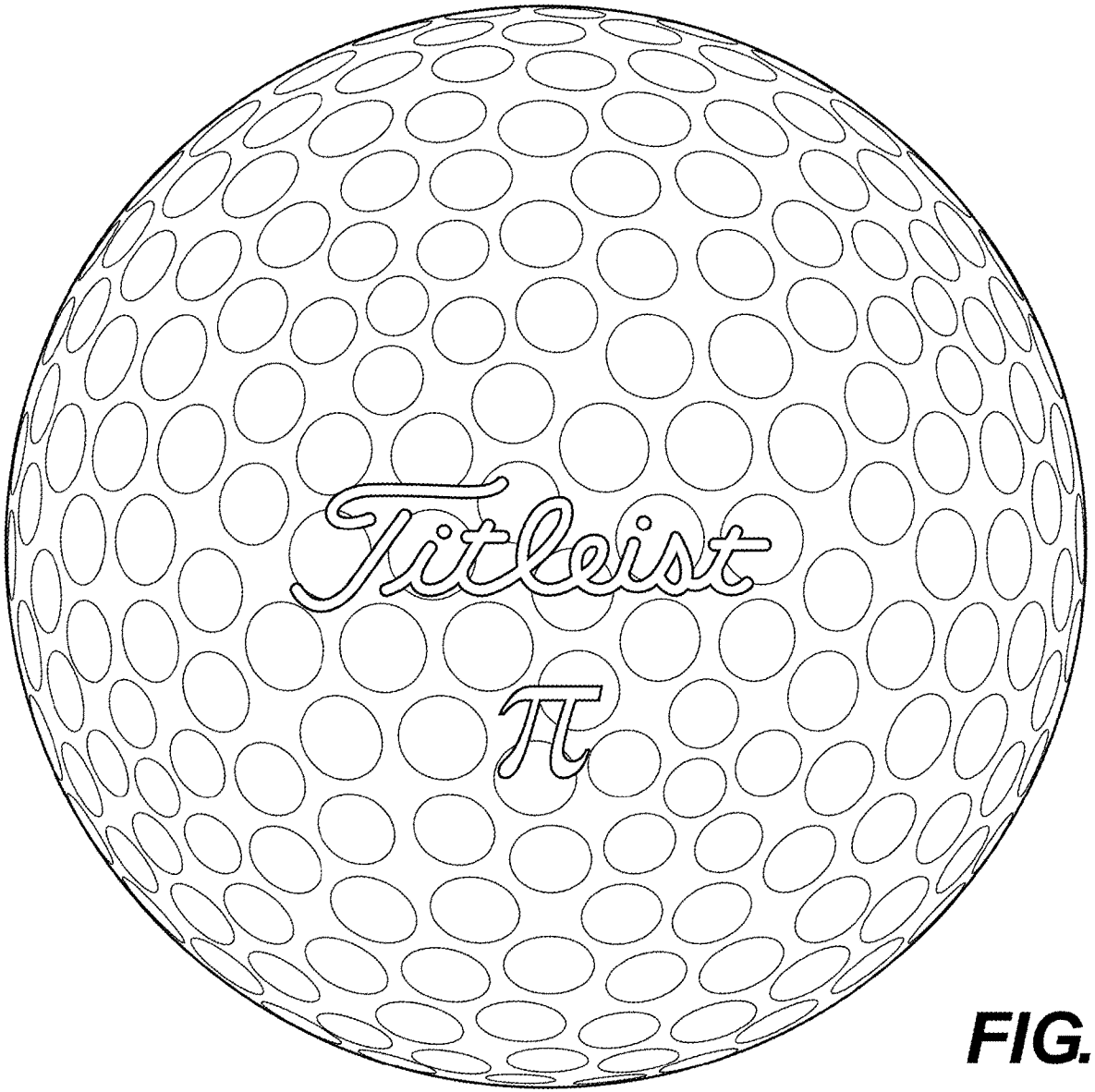
Figure 5F:
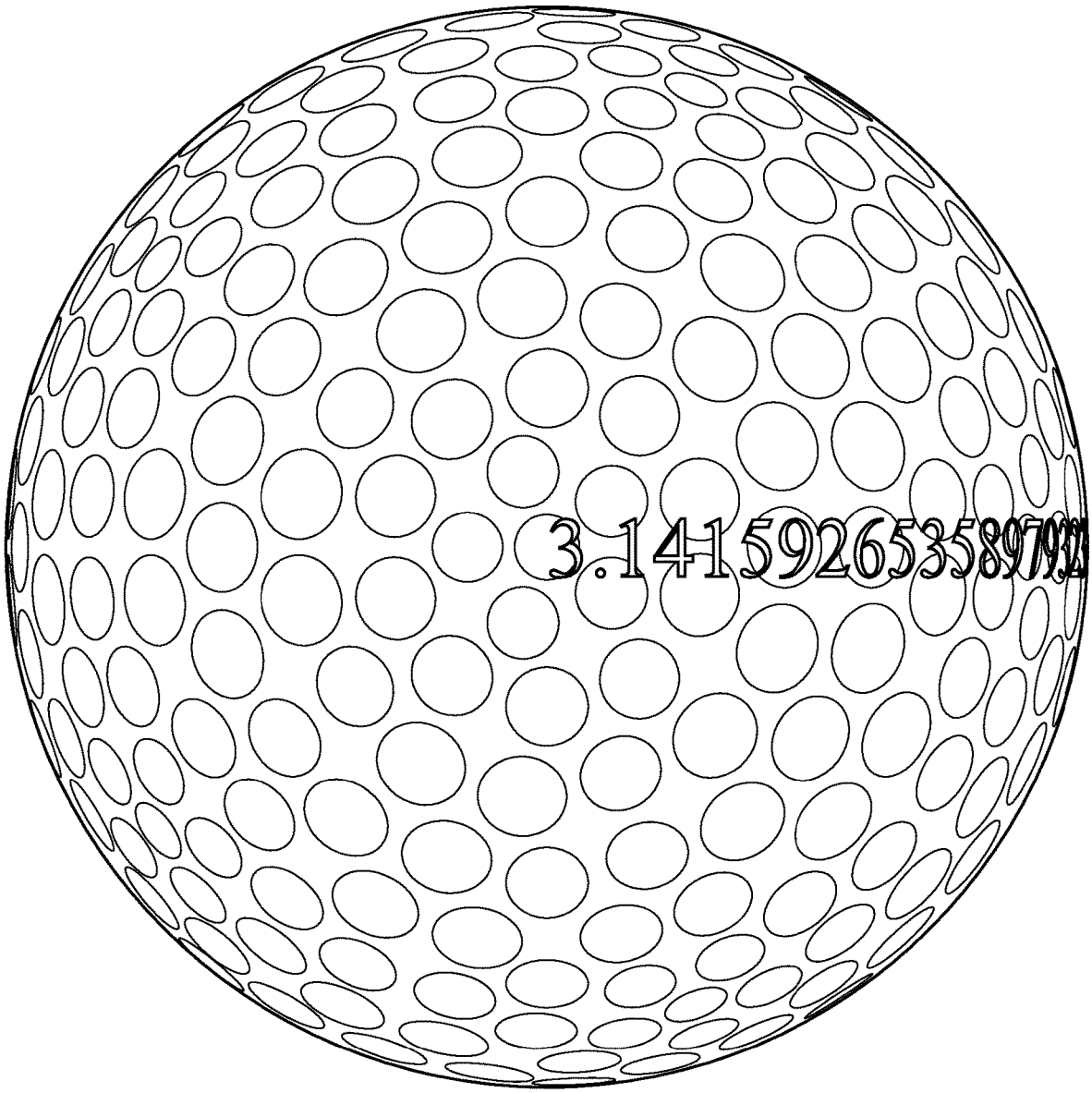
Figure 5G:
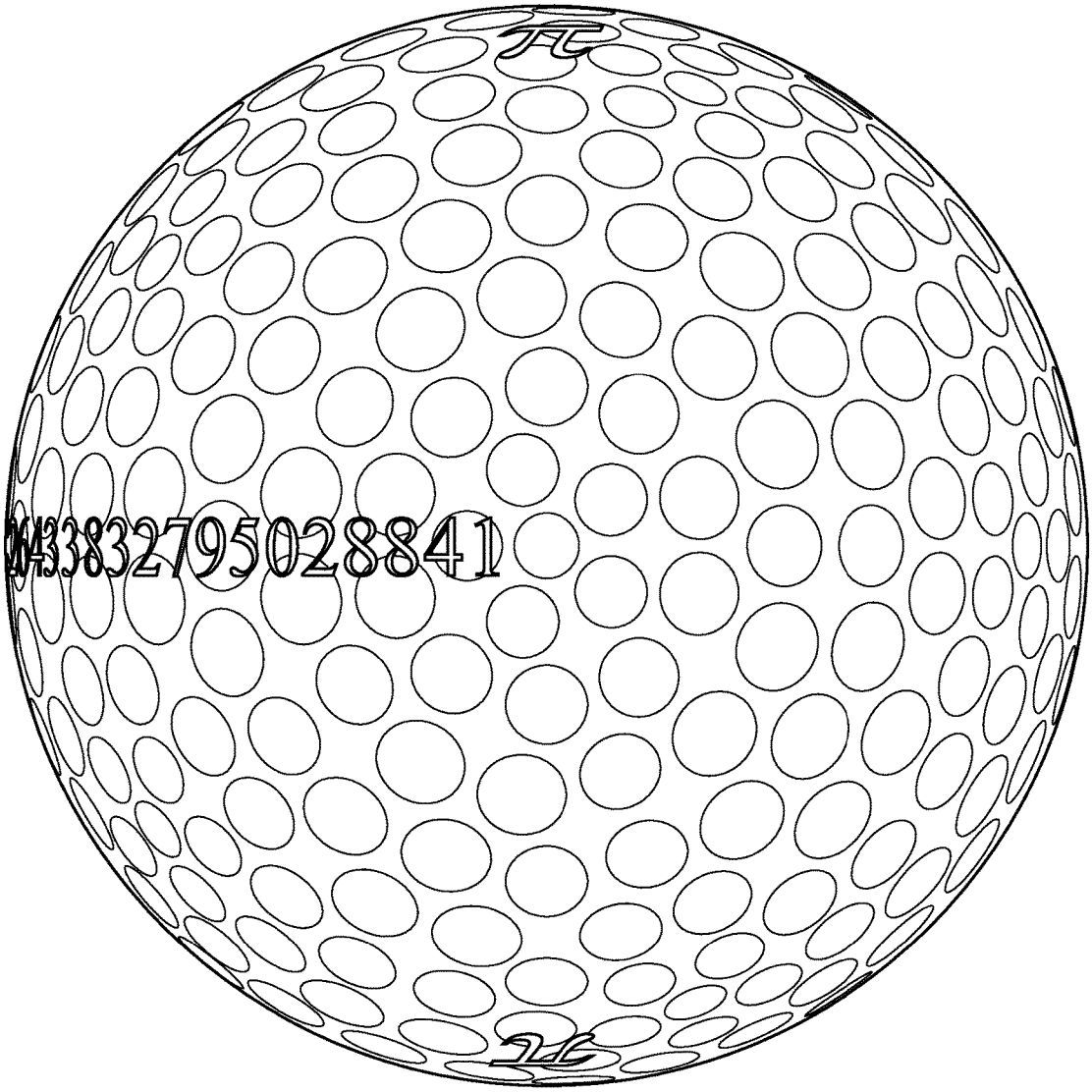
Figure 6A:
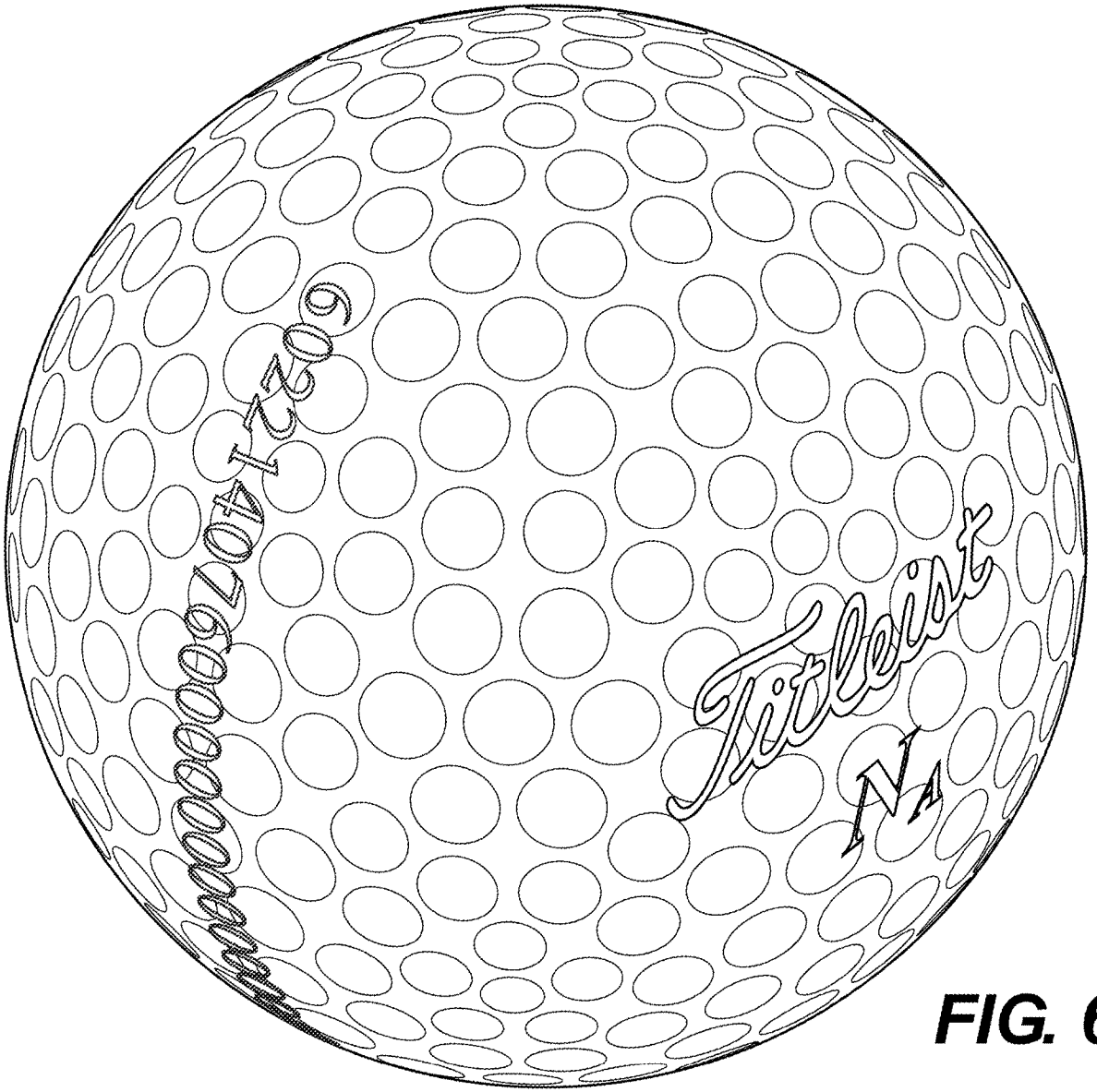
FIGS. 6A-6G are examples of golf balls with sighting aids according to an embodiment of the invention.
Figure 6B:
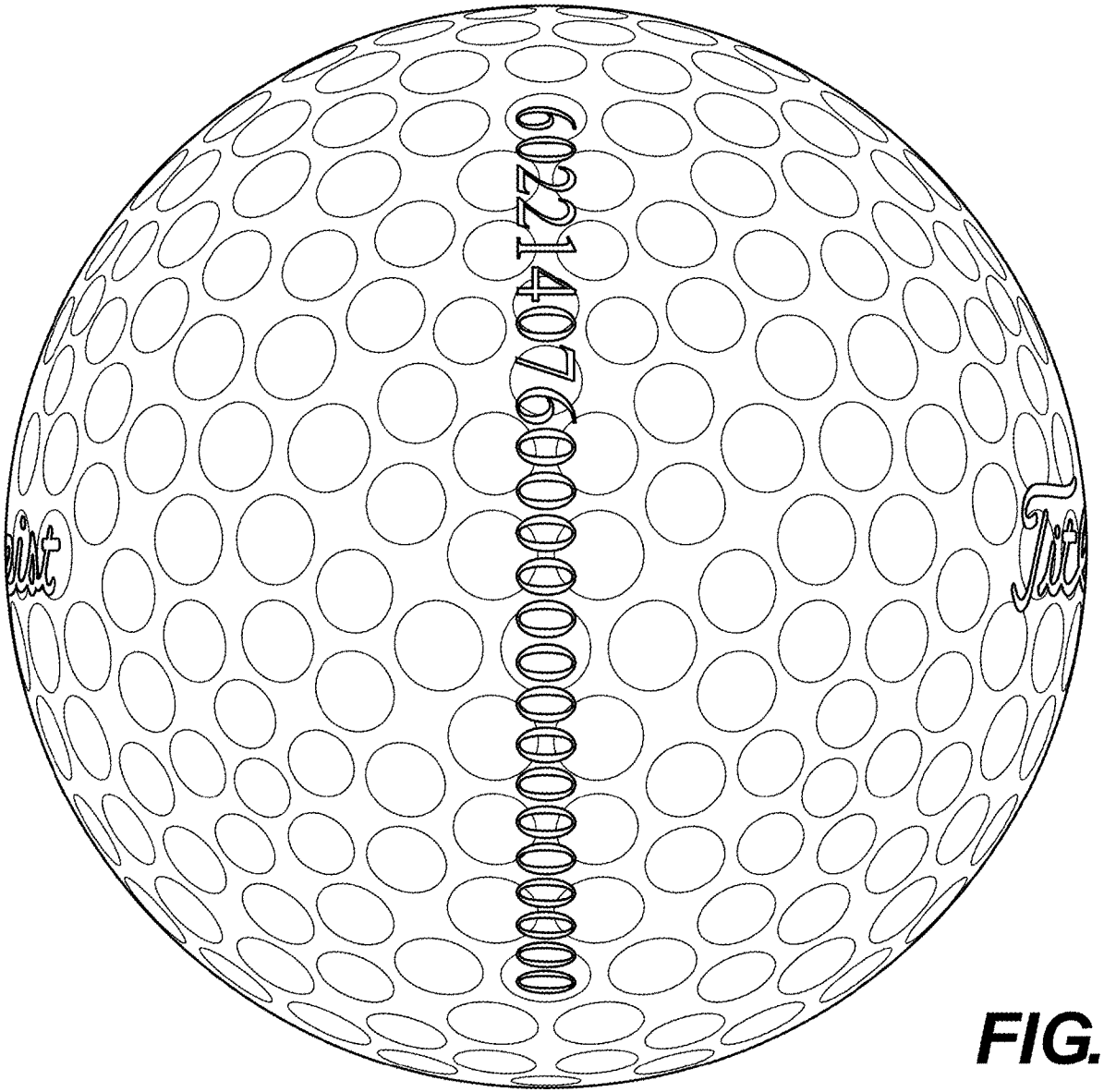
Figure 6C:
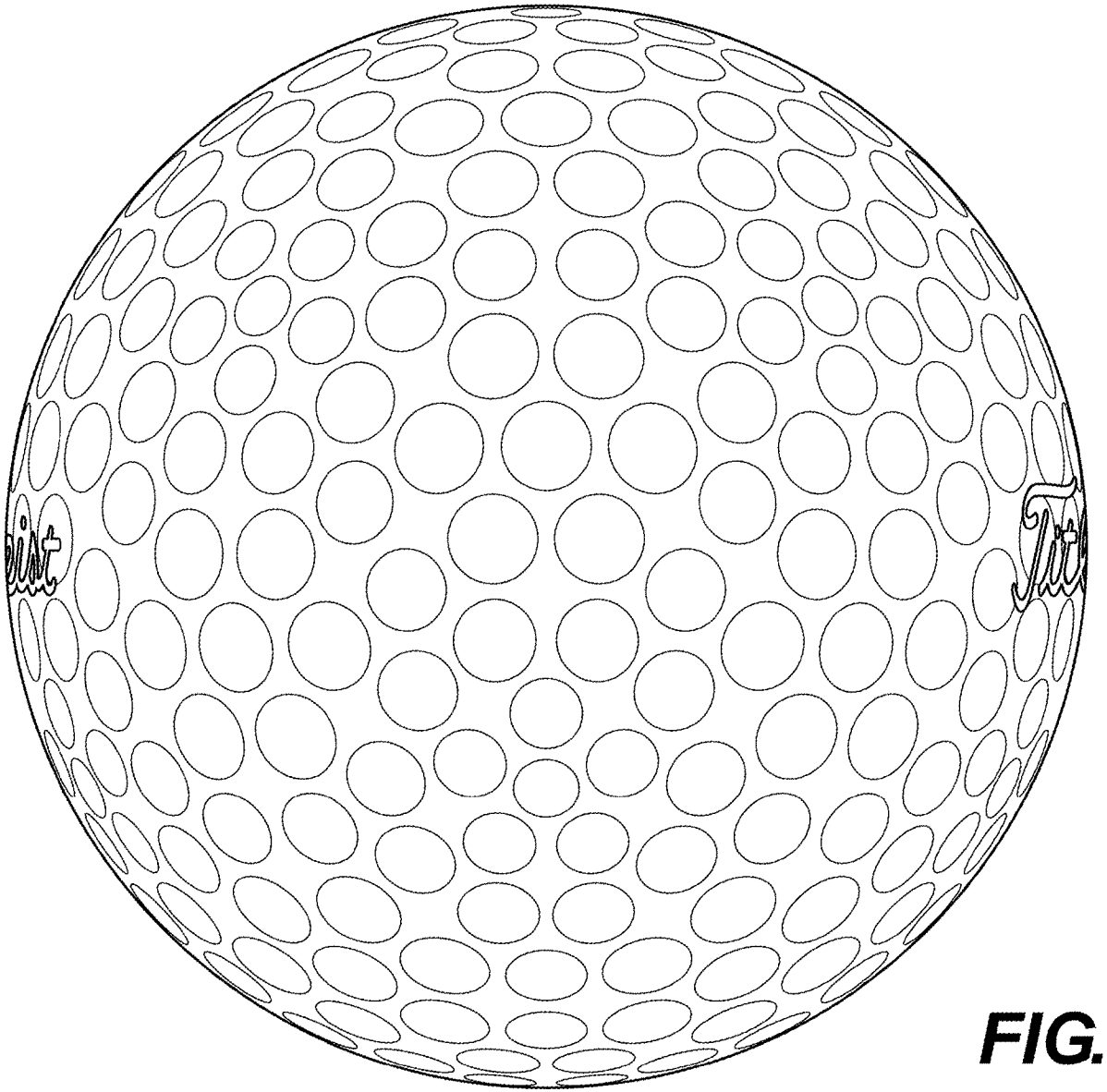
Figure 6D:
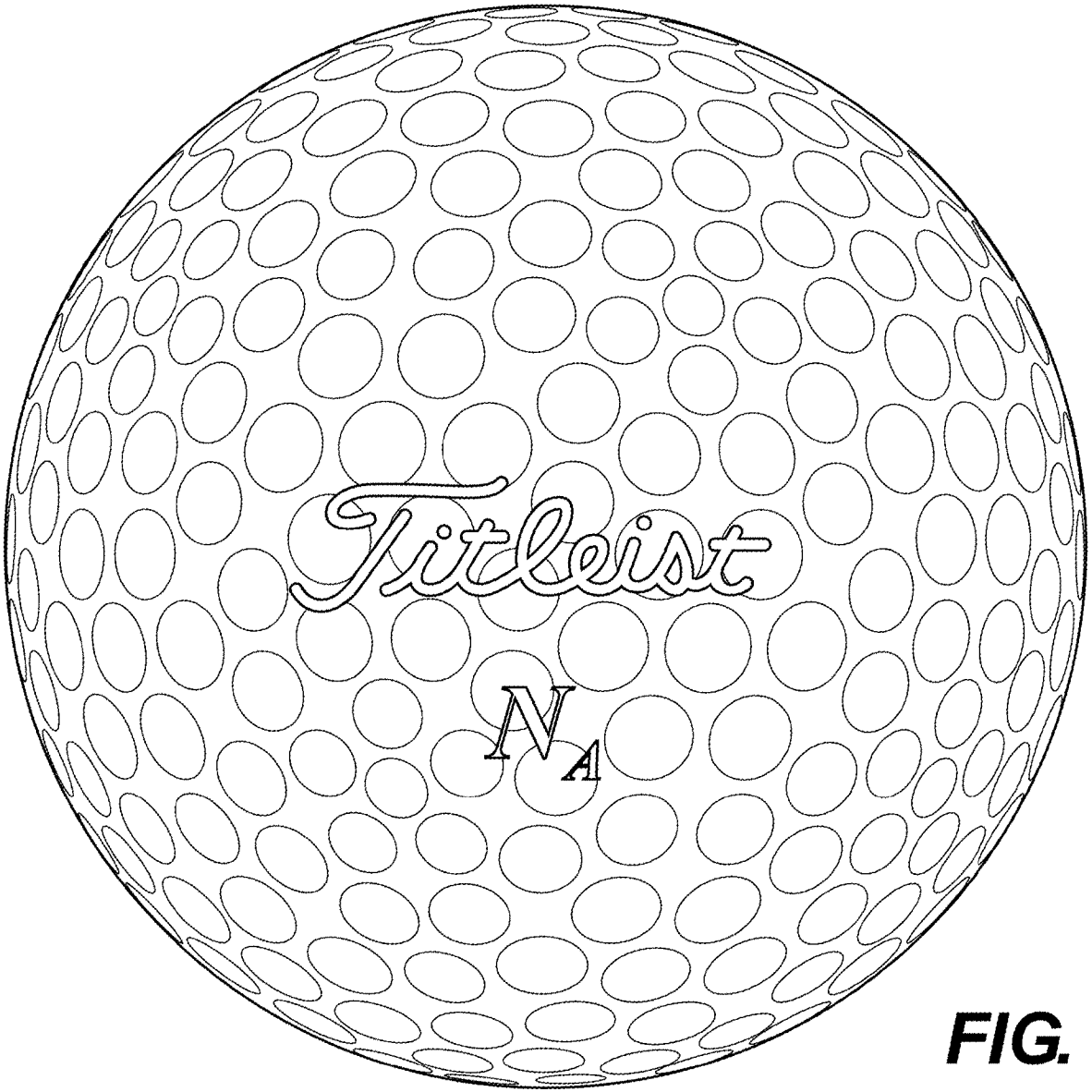
Figure 6E:
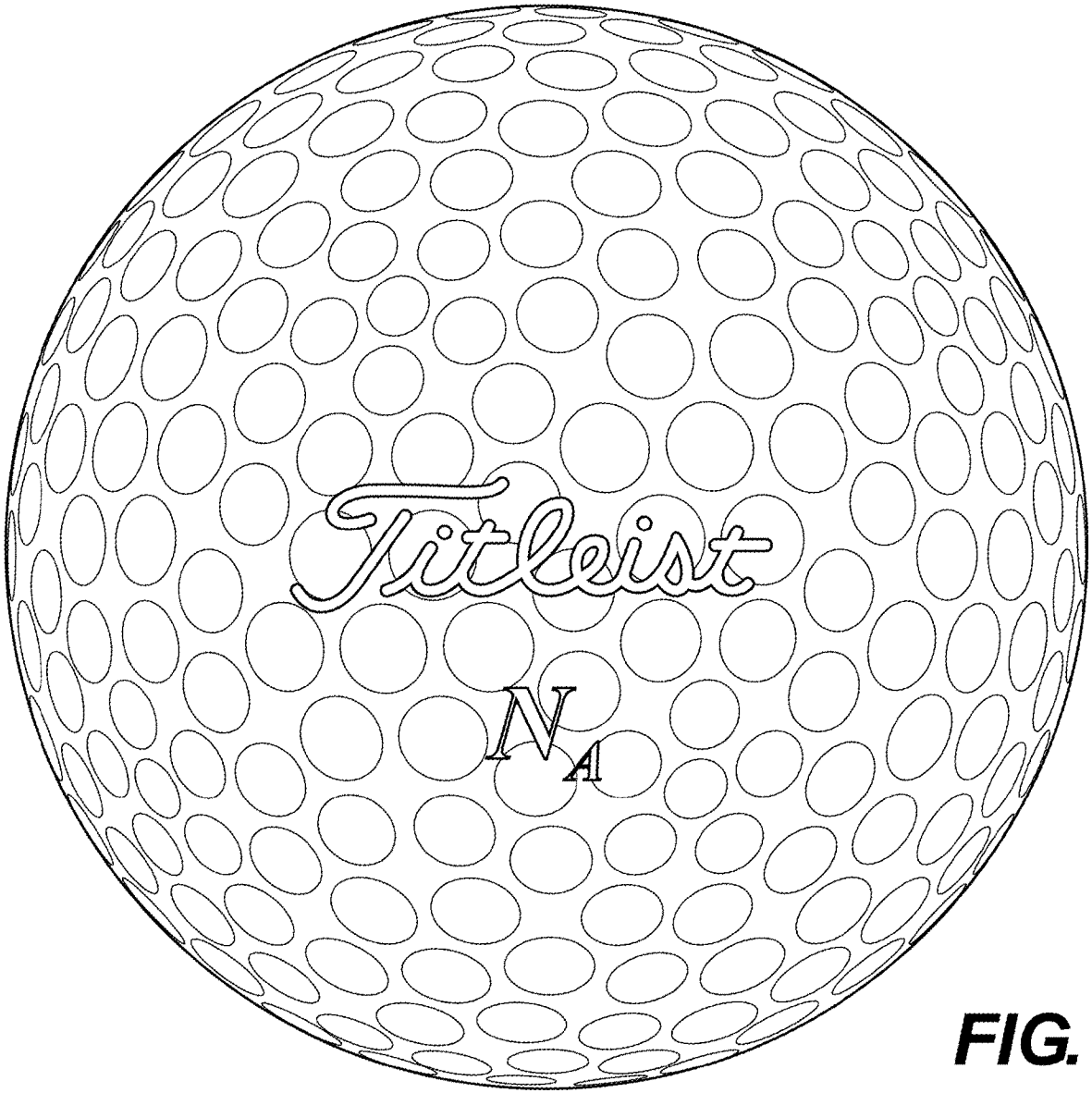
Figure 6F:
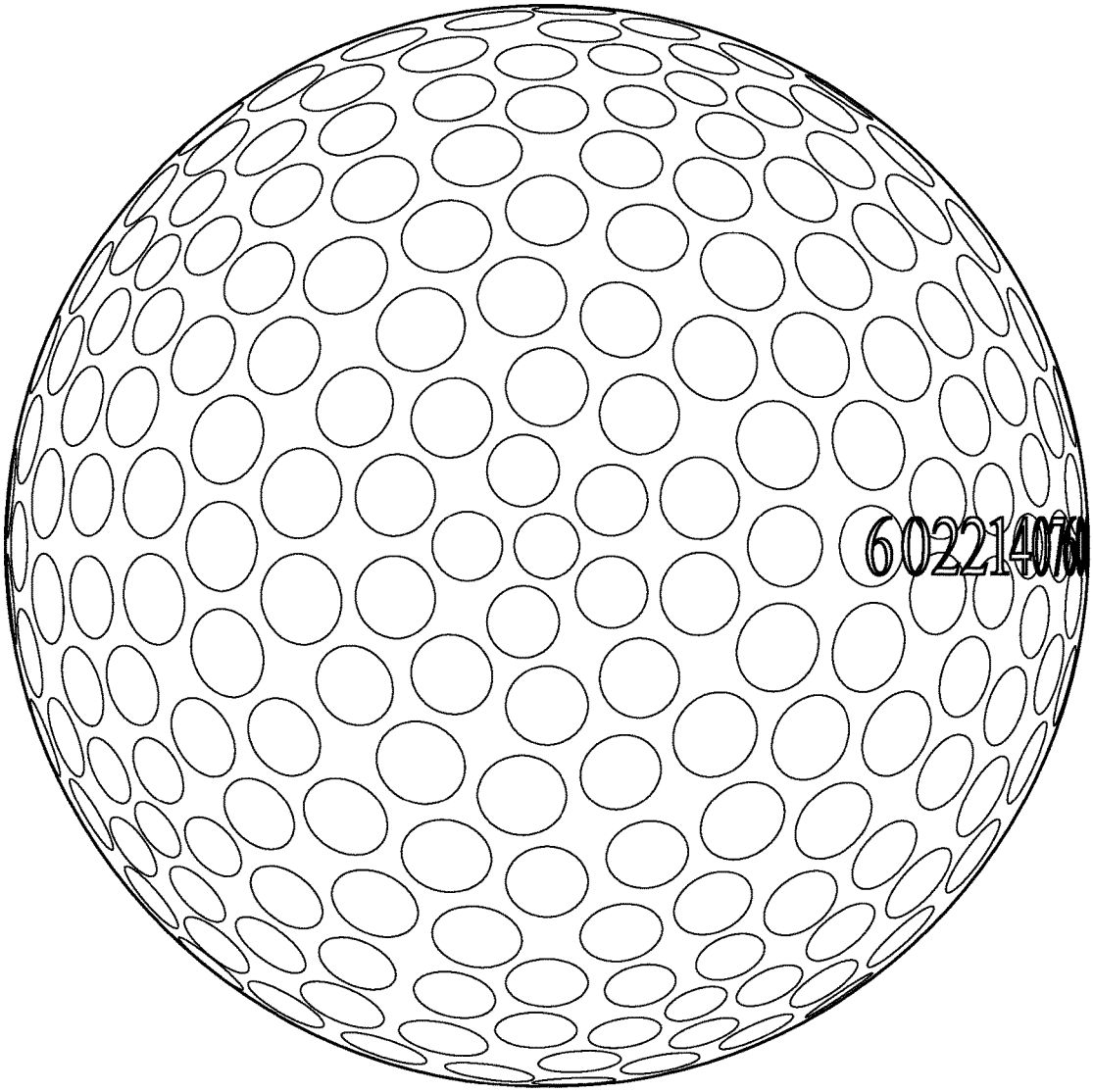
Figure 6G:
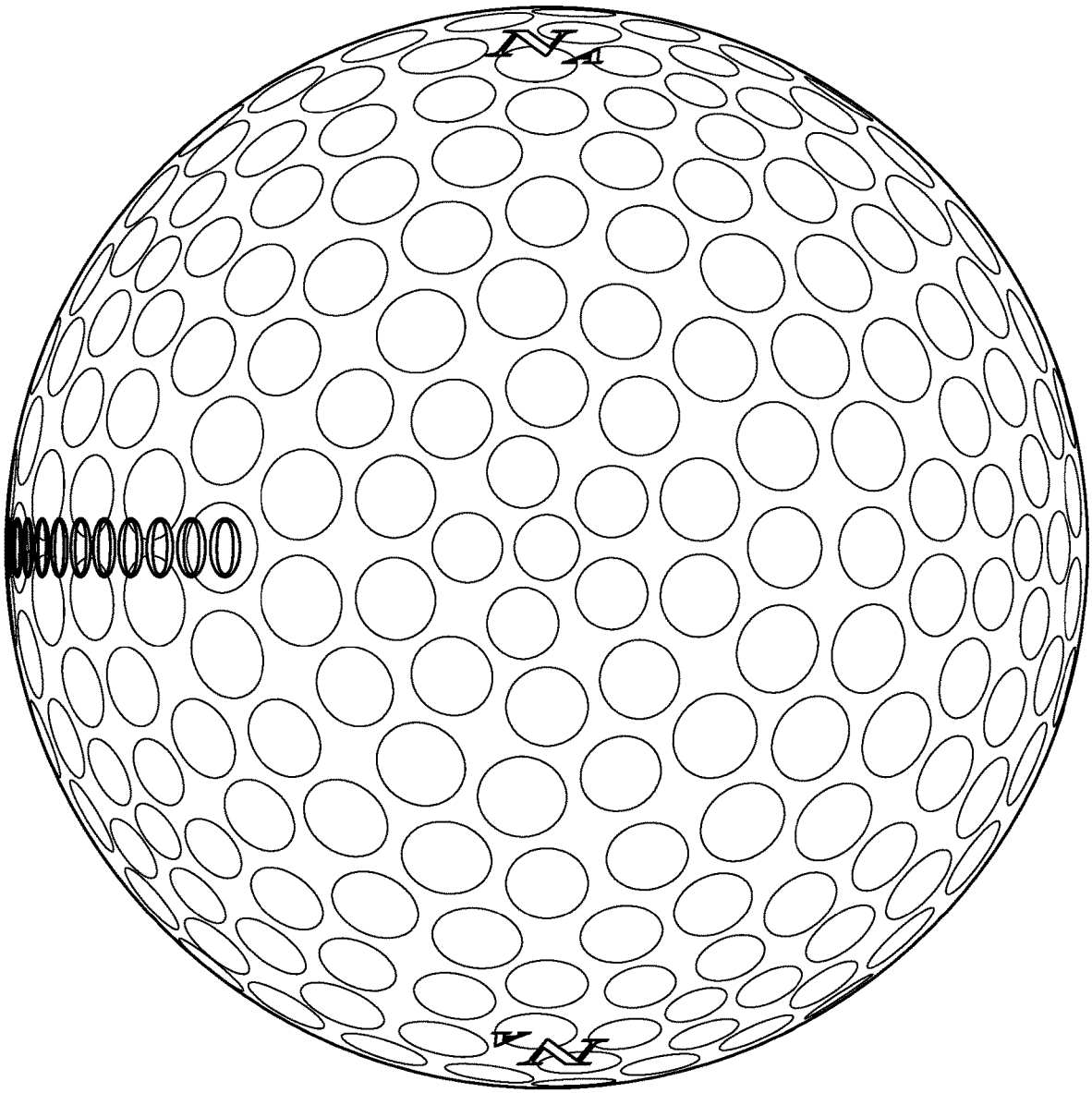
Figure 7A:
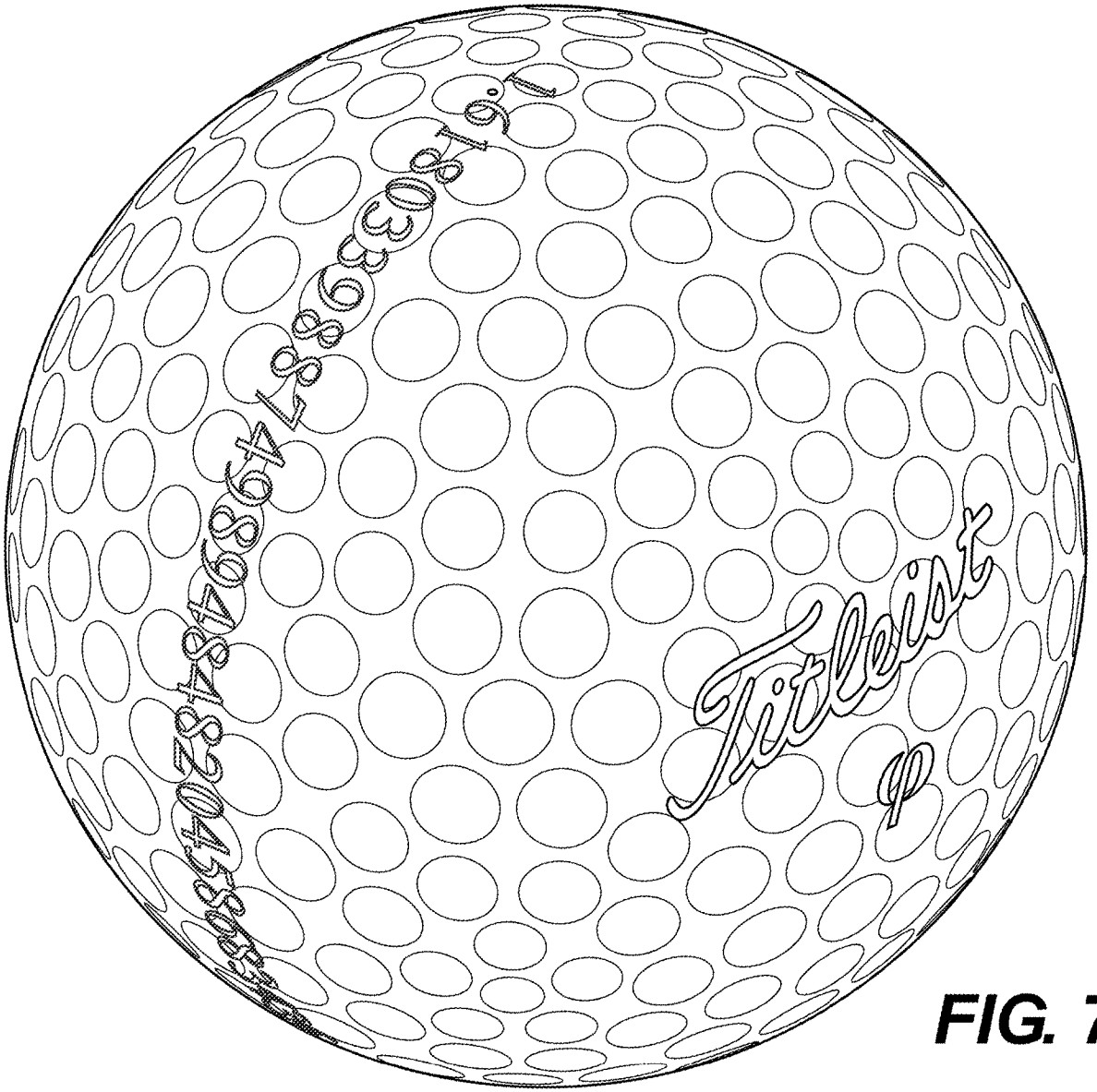
FIGS. 7A-7G are examples of golf balls with sighting aids according to an embodiment of the invention.
Figure 7B:
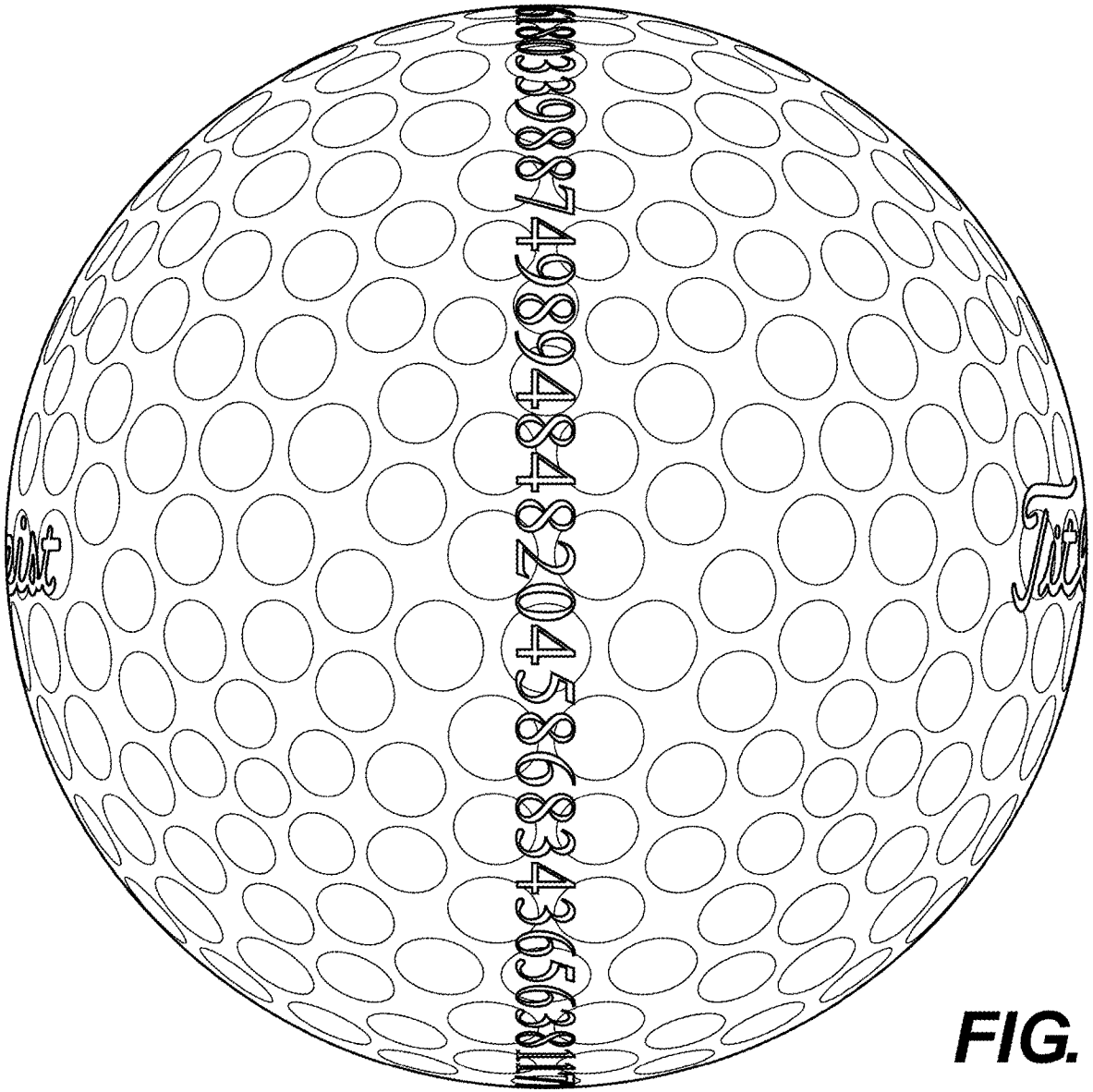
Figure 7C:
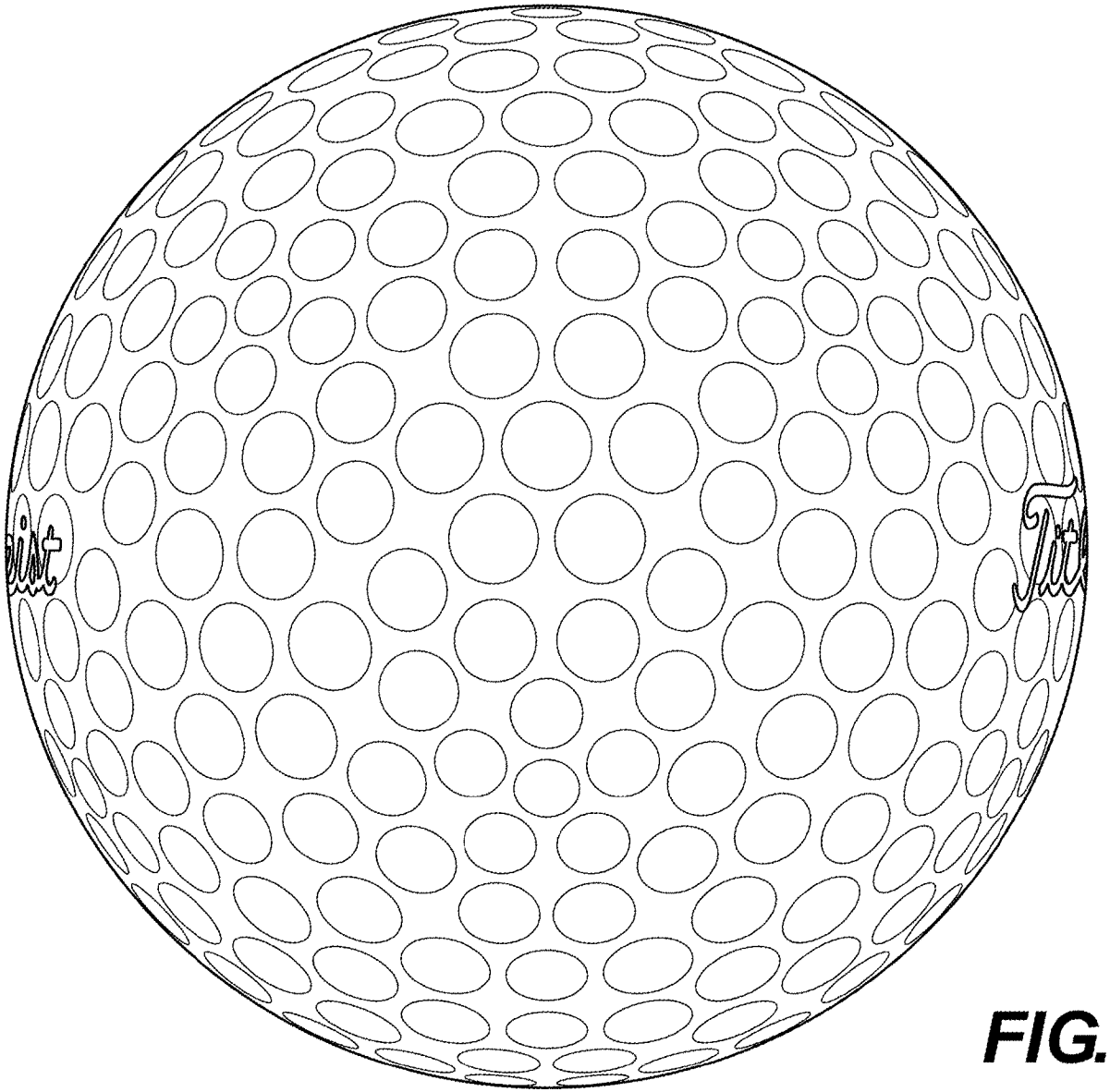
Figure 7D:
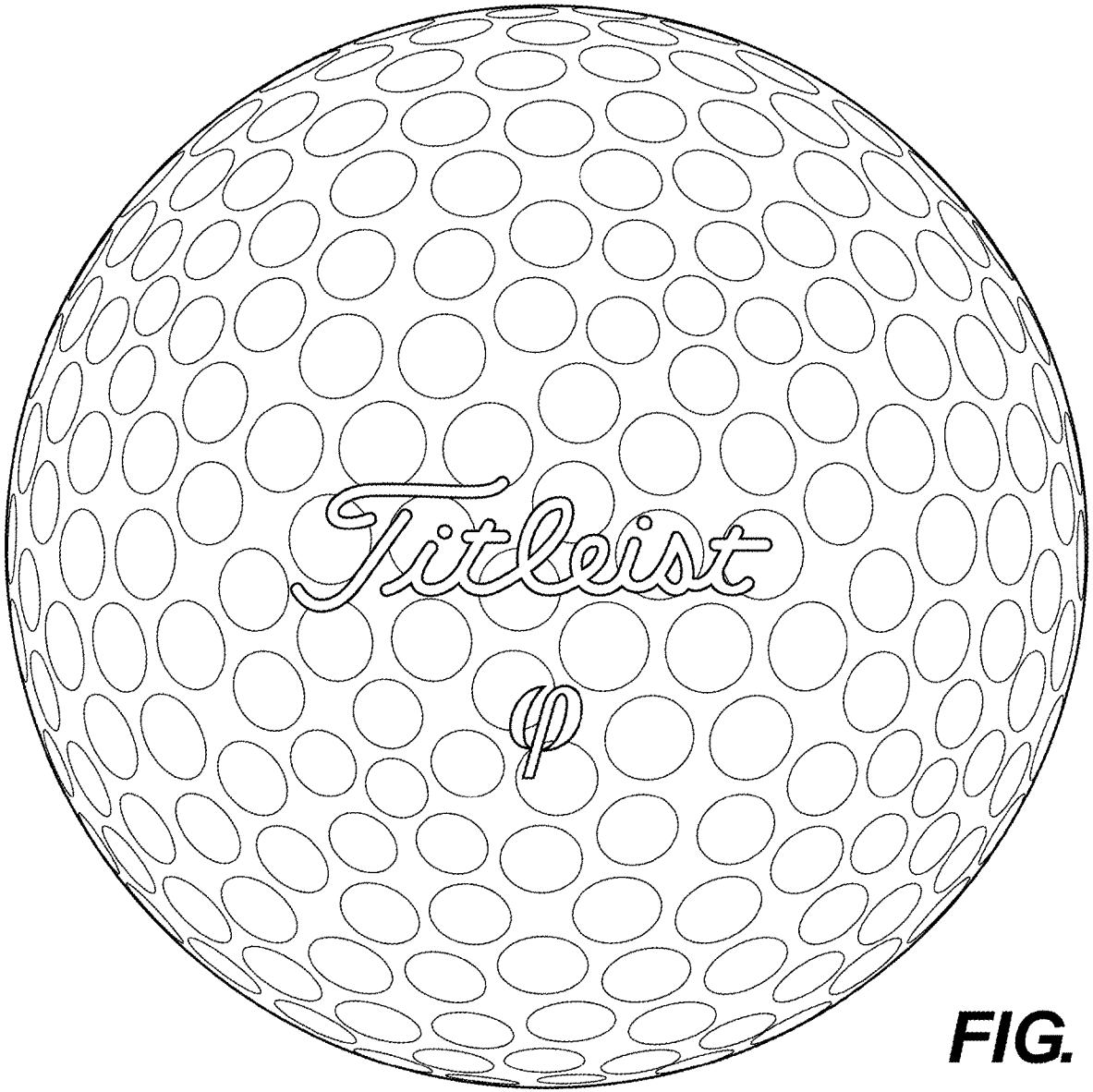
Figure 7E:
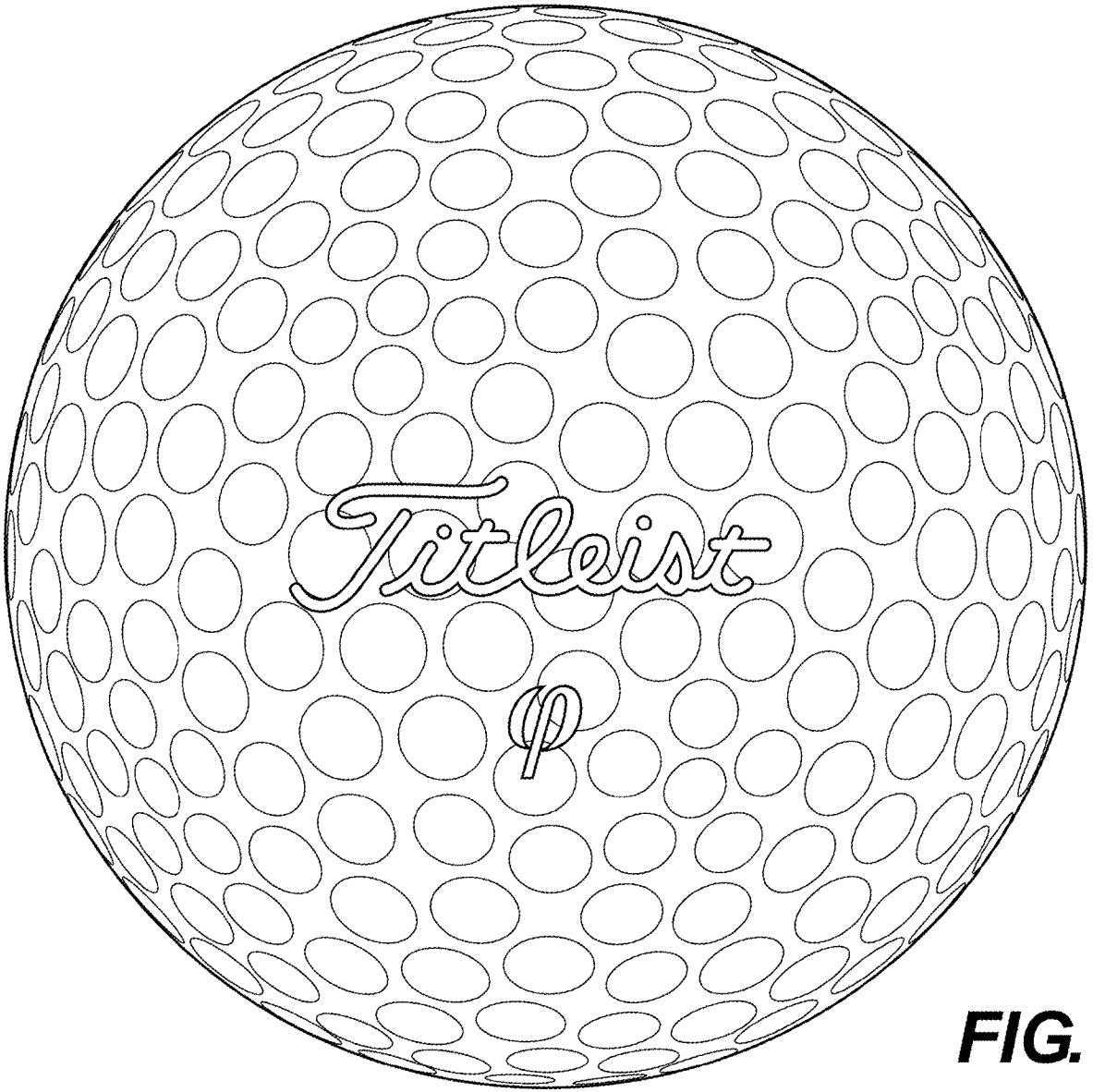
Figure 7F:
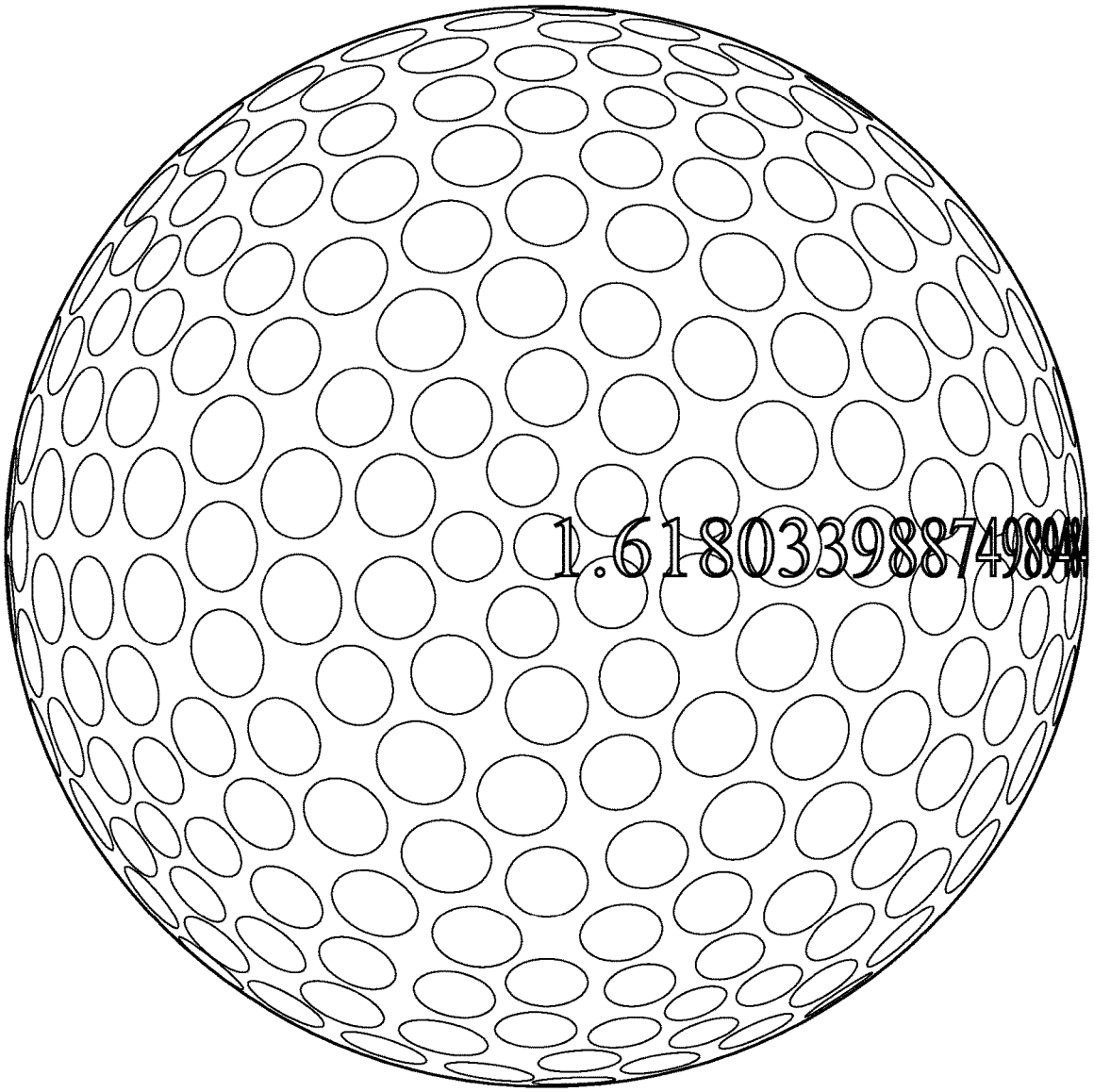
Figure 7G:
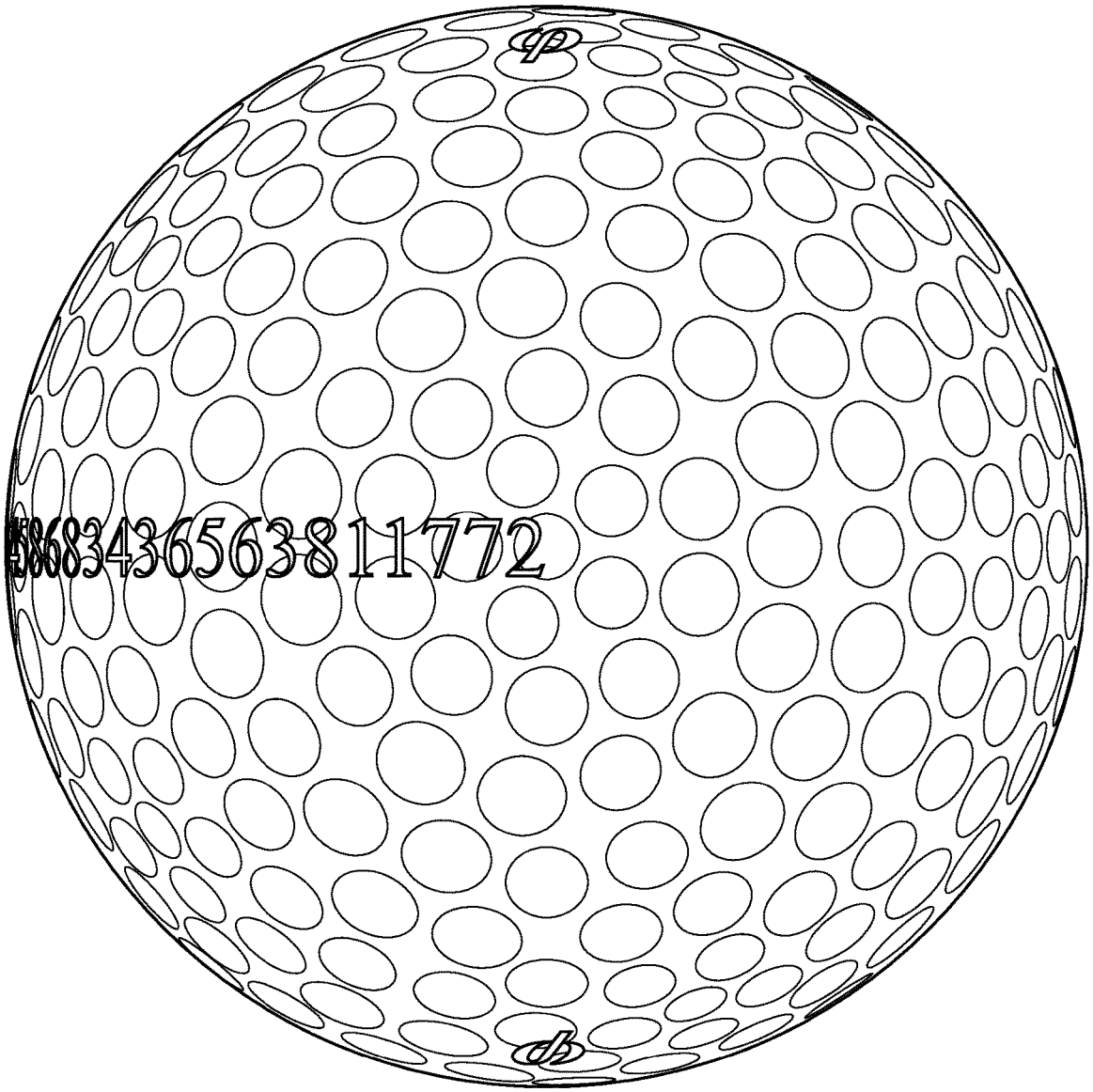
Figure 8A:
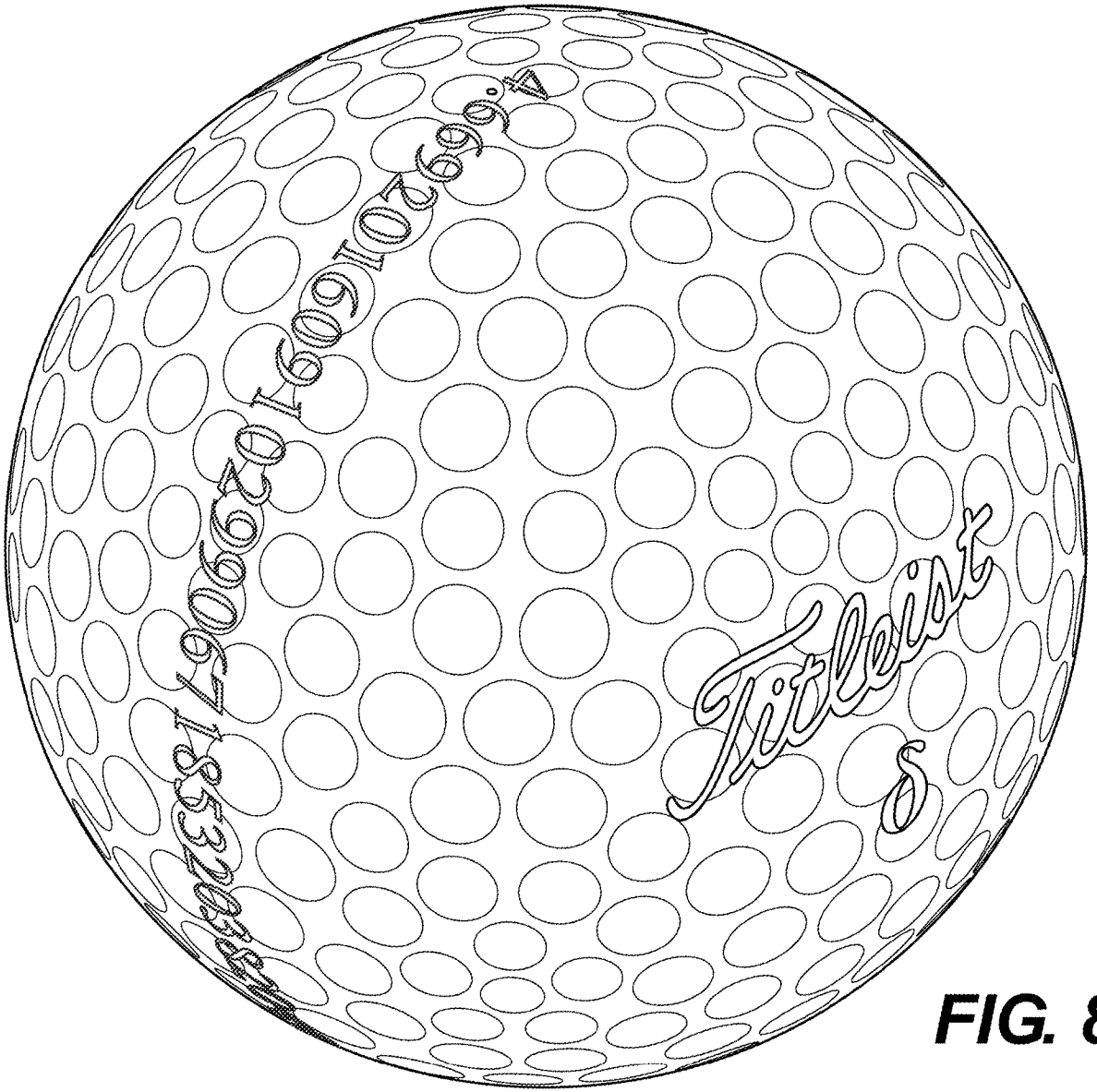
FIGS. 8A-8G are examples of golf balls with sighting aids according to an embodiment of the invention.
Figure 8B:
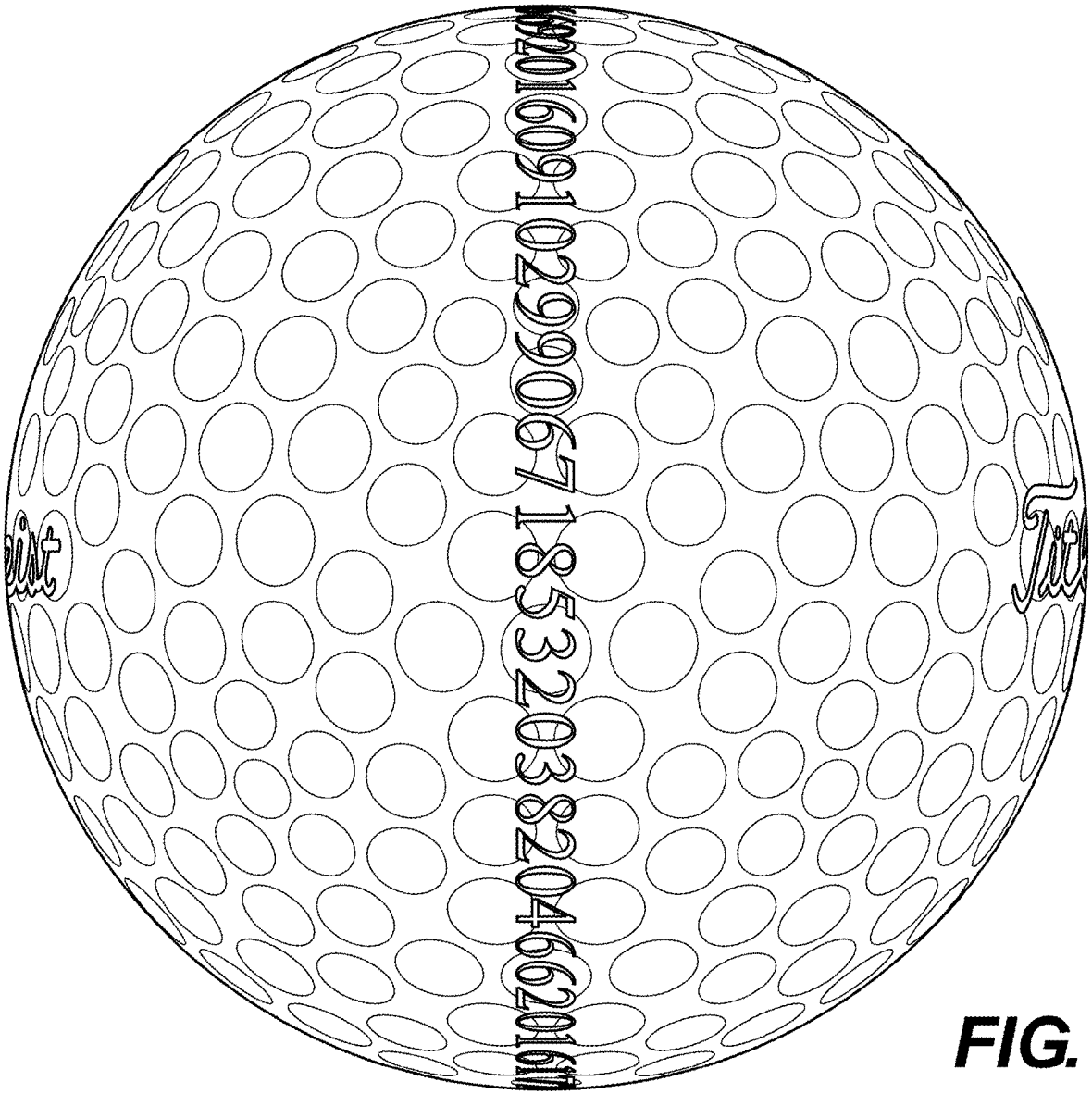
Figure 8C:
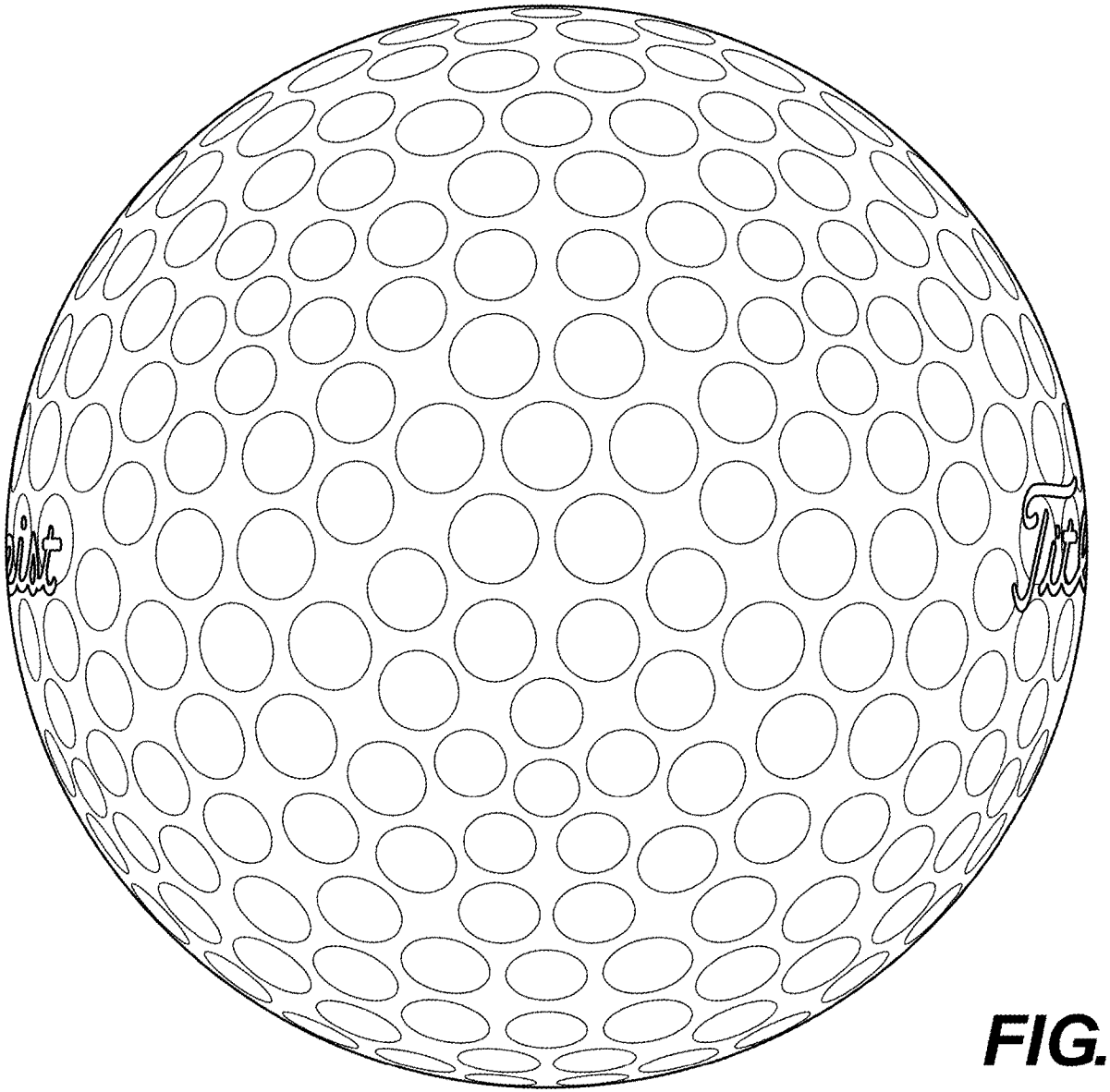
Figure 8D:
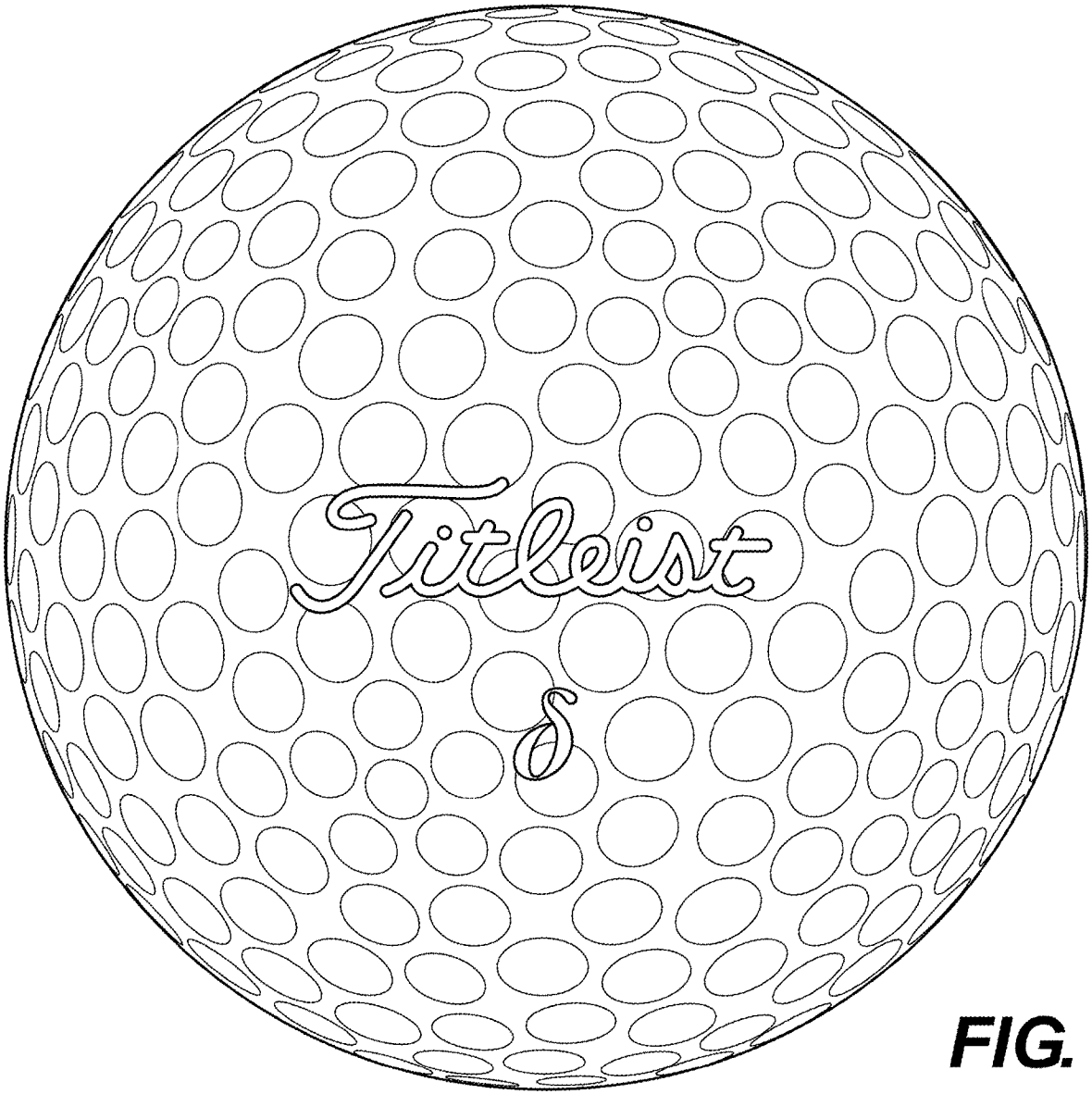
Figure 8E:
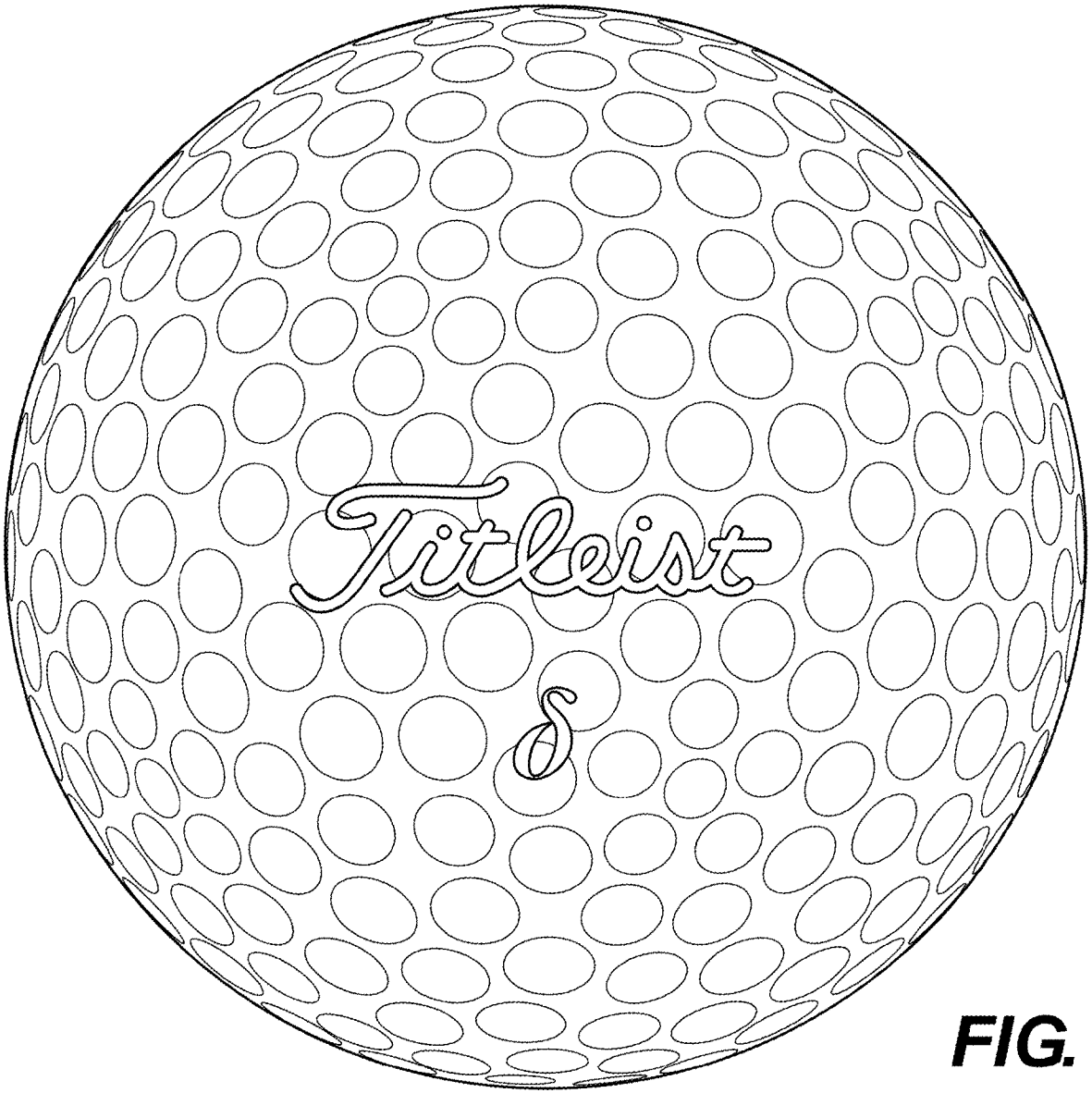
Figure 8F:
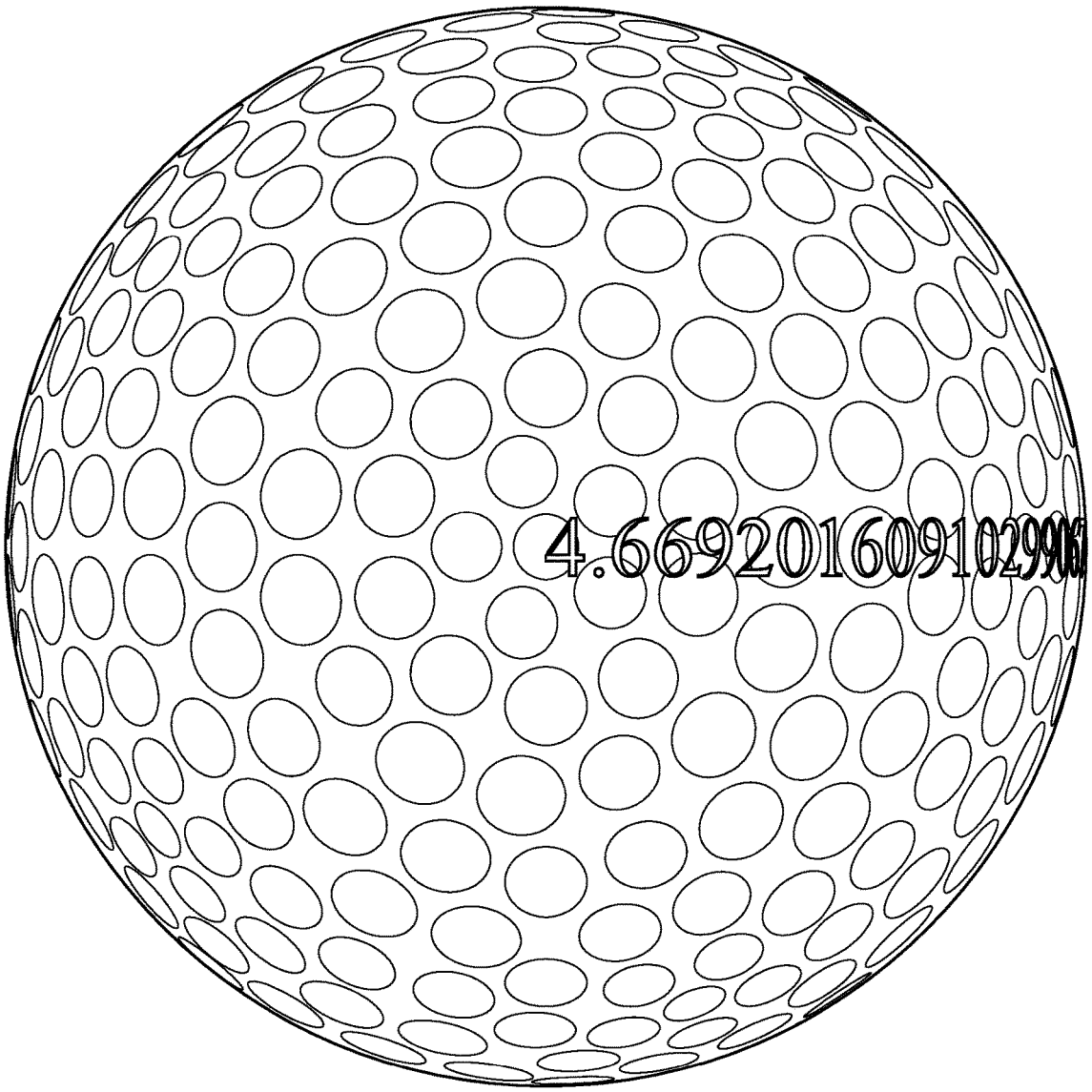
Figure 8G:
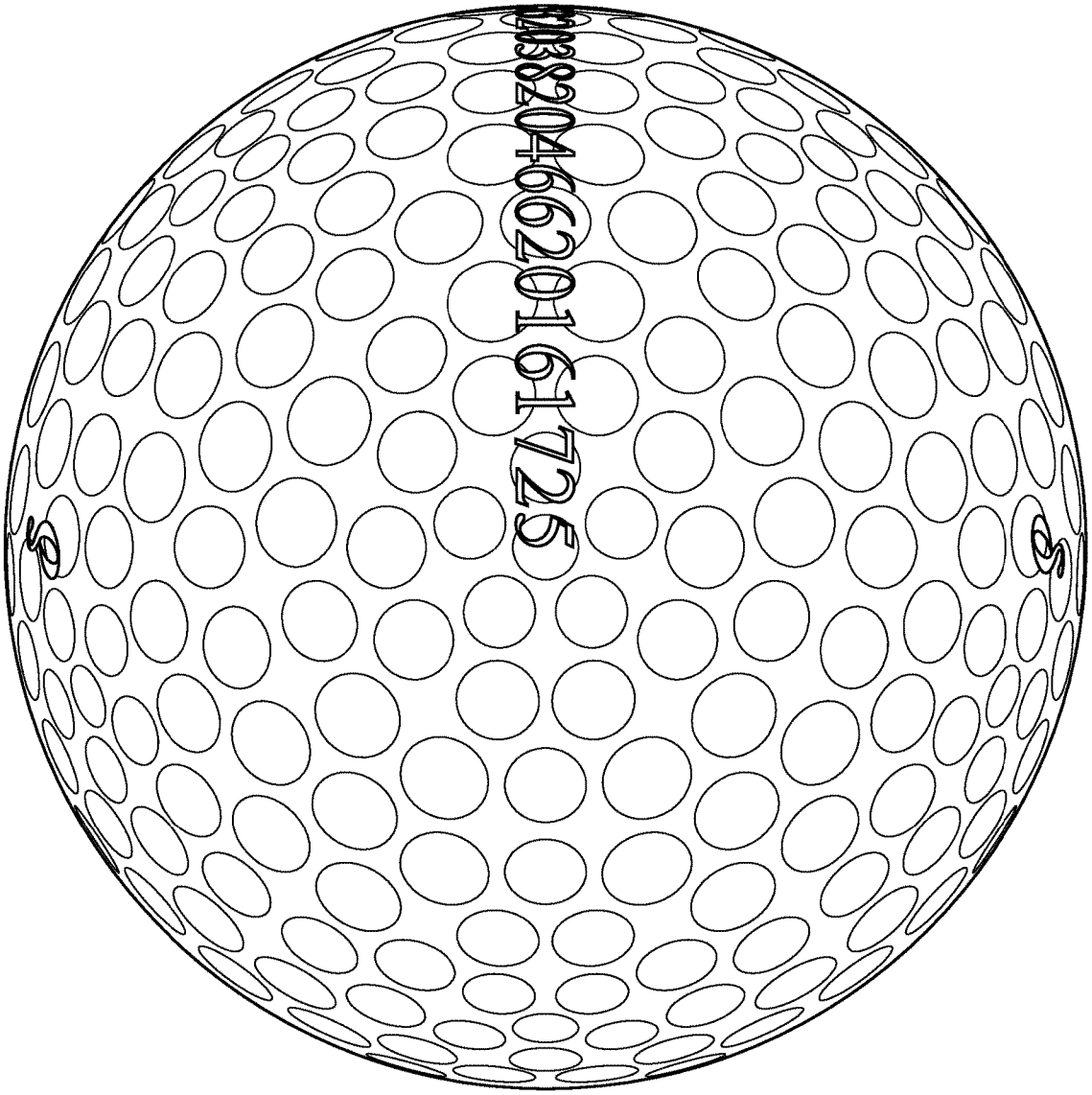

Referring to FIG. 4, the alignment or sighting aid 100 may be disposed on an exterior surface 12 of the golf ball 10 for providing visibility and alignment of the golf ball. In this aspect, the exterior surface 12 of the golf ball may be an outer cover layer or may be a paint layer. The exterior surface 12 of the golf ball 10 may be clear or any color. In one embodiment, the exterior surface 12 of the golf ball is white. The golf ball 10 may include a plurality of dimples 16 formed in the exterior surface 12 of the ball. The number and arrangement of dimples 16 may be varied.

In other embodiments, the sighting aid 100 is disposed on the exterior surface of an inner ball 14 of a golf ball. The inner ball 14 may be composed of a number of components or may be a single component. For example, the inner ball 14 may also include a core 16. In this aspect, the core 16 may also include any number of layers, e.g., a center, an outer core layer, and the like. Regardless of whether the sighting aid 100 is marked upon the exterior surface of the golf ball or an exterior surface of the inner ball, sighting aid 100 provides a visible reference or aid on the golf ball 10 to provide a golfer with the ability to accurately align a golf ball, a club, or both before striking the ball thus causing the golf ball to travel along an intended direction. In this aspect, when the sighting aid 100 is applied to the exterior surface of the inner ball 14, any outer layers may be clear or have a degree of transparency that allows the sighting aid 100 to be visible to a golfer.

Golf Ball Construction

The sighting aids described herein may be used with practically any type of ball construction. For instance, as briefly discussed in the preceding section, the golf ball may have a two-piece design, a dual cover, or dual core construction depending on the type of performance desired of the ball. Other suitable golf ball constructions include multiple intermediate layers.

The golf ball 10 may be any golf ball suitable for play. The generally spherical nature of the golf ball 10 is such that a hemispherical plane extends through a midline M of the golf ball dividing the golf ball into two halves or hemispheres. In one embodiment, the golf ball 10 is in accordance with the United States Golf Association (USGA) Rules, which limits the minimum size of a competition golf ball to 1.680 inches. There is no specification as to the maximum diameter, and golf balls of any size can be used for recreational play. Golf balls made in accordance with the present disclosure can have an overall diameter of any size, and, typically, have an overall diameter of from 1.680 inches to 1.780 inches. Dimensions of each golf ball layer, for example, thickness and diameter, may vary depending on the desired properties. For example, the golf ball 10 may have a diameter of at least about 1.68 inches and a weight of about 1.62 ounces or less.

Golf balls of the present disclosure have a plurality of dimples on the outer surface thereof. In some embodiments, the golf balls of the present disclosure have an overall dimple surface coverage of 60 percent or greater. In other embodiments, the golf balls of the present disclosure have an overall dimple surface coverage of 65 percent or greater. In still other embodiments, the golf balls of the present disclosure have an overall dimple surface coverage of 75 percent or greater. In yet other embodiments, the golf balls of the present disclosure have an overall dimple surface coverage of 80 percent or greater.

Different materials may be used in the construction of golf balls according to the present disclosure. Suitable materials include, but are not limited to, thermosetting materials, such as polybutadiene, styrene butadiene, isoprene, polyisoprene, and trans-isoprene; thermoplastics, such as ionomer resins, polyamides and polyesters; and thermoplastic and thermosetting polyurethane and polyureas.

Particularly suitable thermosetting materials include, but are not limited to, thermosetting rubber compositions including a base polymer, an initiator agent, a coagent and/or a curing agent, and optionally one or more of a metal oxide, metal fatty acid or fatty acid, antioxidant, soft and fast agent, fillers, and additives. Suitable base polymers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, acrylonitrile butadiene rubber, polychloroprene, alkyl acrylate rubber, chlorinated isoprene rubber, acrylonitrile chlorinated isoprene rubber, polyalkenamers, and combinations of two or more thereof. Suitable initiator agents include organic peroxides, high energy radiation sources capable of generating free radicals, C—C initiators, and combinations thereof. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

Other suitable materials for the golf balls of the present disclosure may also include, but are not limited to: thermosetting polyurethanes, polyureas, and hybrids of polyurethane and polyurea; thermoplastic polyurethanes, polyureas, and hybrids of polyurethane and polyurea, including, for example, Estane® TPU, commercially available from The Lubrizol Corporation; E/X- and E/X/Y-type ionomers, where E is an olefin (e.g., ethylene), X is a carboxylic acid (e.g., acrylic, methacrylic, crotonic, maleic, fumaric, or itaconic acid), and Y is a softening comonomer (e.g., vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons), such as Surlyn® ionomer resins commercially available from The Dow Chemical Company; polyisoprene; polyoctenamer, such as Vestenamer® polyoctenamer, commercially available from Evonik Industries; polyethylene, including, for example, low density polyethylene, linear low density polyethylene, and high density polyethylene; polypropylene; rubber-toughened olefin polymers; non-ionomeric acid copolymers; plastomers; flexomers; styrene/butadiene/styrene block copolymers; styrene/ethylene-butylene/styrene block copolymers; polybutadiene; styrene butadiene rubber; ethylene propylene rubber; ethylene propylene diene rubber; dynamically vulcanized elastomers; ethylene vinyl acetates; ethylene (meth) acrylates; polyvinyl chloride resins; polyamides, amide-ester elastomers, and copolymers of ionomer and polyamide, including, for example, Pebax® thermoplastic polyether and polyester amides, commercially available from Arkema Inc; crosslinked trans-polyisoprene; polyester-based thermoplastic elastomers, such as Hytrel® polyester elastomers, commercially available from E. I. du Pont de Nemours and Company, and Riteflex® polyester elastomers, commercially available from Ticona; polyurethane-based thermoplastic elastomers, such as Elastollan® polyurethanes, commercially available from BASF; synthetic or natural vulcanized rubber; and combinations thereof.

EXAMPLES

The following non-limiting examples demonstrate sighting aids that may be made in accordance with the present disclosure. The examples are merely illustrative of the preferred embodiments of the present disclosure and are not to be construed as limiting the disclosure, the scope of which is defined by the appended claims.

Example 1

Sighting aids composed of a variety of characters and varying point sizes (using News Gothic font) are provided in Table 1 below. The golf balls have a diameter of 1.68 inches.

TABLE 1

| Sighting Aids | | | | | |
|---|---|---|---|---|---|
| Point Size | N | W | $H_{SA}$ | Wrap (%) | Surface Coverage (%) |
| About 8 pt | 10 | 0.054 | 0.111 | 24.4 | 0.7 |
| | 15 | 0.054 | 0.111 | 36.5 | 1.0 |
| | 20 | 0.054 | 0.111 | 48.7 | 1.4 |
| | 30 | 0.054 | 0.111 | 73.1 | 2.0 |
| | 40 | 0.054 | 0.111 | 97.4 | 2.7 |
| About 6 pt | 20 | 0.042 | 0.083 | 37.9 | 0.8 |
| | 30 | 0.042 | 0.083 | 56.8 | 1.2 |
| | 40 | 0.042 | 0.083 | 75.8 | 1.6 |
| | 45 | 0.042 | 0.083 | 85.3 | 1.8 |
| | 50 | 0.042 | 0.083 | 94.7 | 2.0 |
| About 4 pt | 20 | 0.024 | 0.055 | 21.7 | 0.3 |
| | 40 | 0.024 | 0.055 | 43.3 | 0.6 |
| | 60 | 0.024 | 0.055 | 65.0 | 0.9 |
| | 80 | 0.024 | 0.055 | 86.6 | 1.2 |
| | 90 | 0.024 | 0.055 | 97.4 | 1.3 |

N, W, $H_{SA}$, Wrap, and Surface Coverage are defined above. In this aspect, by way of a non-limiting example, using the calculations above, a golf ball may include a sighting aid based on the Pi number that wraps about 180° around the perimeter or about 50 percent of the perimeter of the golf ball using 8 pt News Gothic that includes 20 characters. In particular, the sighting aid may be based on the Pi number as follows:

3.141592653589793238

Note that the decimal point counts as a character. Similarly, using the calculations above, a golf ball may include a sighting aid based on the Pi number that wraps almost entirely around the perimeter of the golf ball using 8 pt News Gothic that includes 40 characters. In particular, the sighting aid may be based on the Pi number as follows:

3.1415926535897932384626433832795028841 9

Any of these golf balls may also include a Pi symbol, i.e., 7C, in another area of the golf ball. FIGS. 5A-5G generally show the sighting aid based on the Pi number with a 50 percent or 180° wrap.

In another aspect, by way of a non-limiting example, using the calculations above, a golf ball may include a sighting aid based on the Euler's number that wraps a little more than 180° around the perimeter or about 50 percent of the perimeter of the golf ball using 8 pt News Gothic that includes 20 characters. In particular, the sighting aid may be based on the Euler's number as follows:

2.718281828459045235

This golf ball may also include the symbol for Euler's number, i.e., e, in another area of the golf ball.

FIGS. 6A-6G, FIGS. 7A-7G, and FIGS. 8A-8G illustrate specific embodiments of the present disclosure. More specifically, FIGS. 6A-6G illustrate the sighting aid based on Avogadro's number, FIGS. 7A-7G illustrate the sighting aid based on the Golden ratio, and FIGS. 8A-8G illustrate the sighting aid based on Feigenbaum's constant.

The golf balls and methods described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the golf balls and the methods in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball having a sighting aid comprising a plurality of characters continuously extending at least partially around a perimeter of the golf ball according to Equation 1:

$$\text{Wrap} = \frac{N * W}{C} * 100 \tag{1}$$

wherein N is the number of characters in the plurality, W is the cell width, and C=circumference of the golf ball, and wherein the characters in the plurality comprise alphanumeric characters, punctuation, national characters, special characters, math symbols, emojis, Greek alphabet letters, or combinations thereof.

2. The golf ball of claim 1, wherein Wrap ranges about 10 percent and 100 percent.

3. The golf ball of claim 2, wherein Wrap is about 40 percent to about 60 percent.

4. The golf ball of claim 1, wherein the sighting aid has a surface coverage according to Equation 2:

$$SC = \frac{H_{SA} * N * W}{A} * 100 \tag{2}$$

where $H_{SA}$ is the height of the sighting aid, N is the number of characters, W is the cell width, and A is the surface area of the golf ball.

5. The golf ball of claim 4, wherein SC is about 0.5 percent to about 25 percent.

6. The golf ball of claim 5, wherein SC is about 1 percent to about 4 percent.

7. The golf ball of claim 1, further comprising a marking orthogonal to the sighting aid that is representative of the plurality of characters in the sighting aid.

8. A golf ball having a sighting aid comprising a plurality of characters extending at least partially around a perimeter of the golf ball according to Equation 1:

$$\text{Wrap} = \frac{N * W}{C} * 100 \tag{1}$$

wherein N is the number of characters in the plurality, W is the cell width, and C=circumference of the golf ball.

9. The golf ball of claim 8, wherein Wrap ranges about 10 percent and 100 percent.

10. The golf ball of claim 8, wherein the sighting aid has a surface coverage according to Equation 2:

$$SC = \frac{H_{SA} * N * W}{A} * 100 \quad (2)$$

where $H_{SA}$ is the height of the sighting aid, N is the number of characters, W is the cell width, and A is the surface area of the golf ball.

11. The golf ball of claim 10, wherein SC is about 0.5 percent to about 25 percent.

12. The golf ball of claim 8, wherein the characters in the plurality comprise alphanumeric characters, punctuation, national characters, special characters, math symbols, emojis, Greek alphabet letters, or combinations thereof.

13. The golf ball of claim 8, comprising an inner subassembly and an outer layer disposed on the inner subassembly, wherein the sighting aid is applied to the outer layer.

14. The golf ball of claim 8, comprising an inner subassembly and an outer layer disposed on the inner subassembly, wherein the outer layer is clear, and wherein the sighting aid is applied to the inner subassembly.

15. A golf ball comprising:

an inner subassembly;

an outer layer disposed on the inner subassembly; and a sighting aid applied to one of the inner subassembly or outer layer, wherein the sighting aid comprises a plurality of characters extending at least partially around a perimeter of the golf ball according to Equation 1:

$$\text{Wrap} = \frac{N * W}{C} * 100 \quad (1)$$

wherein N is the number of characters in the plurality, W is the cell width, and C=circumference of the golf ball, and wherein the sighting aid has a surface coverage according to Equation 2:

$$SC = \frac{H_{SA} * N * W}{A} * 100 \quad (2)$$

where $H_{SA}$ is the height of the sighting aid and A is the surface area of the golf ball.

16. The golf ball of claim 15, wherein the characters in the plurality comprise alphanumeric characters, punctuation, national characters, special characters, math symbols, emojis, Greek alphabet letters, or combinations thereof.

17. The golf ball of claim 15, wherein SC is about 0.5 percent to about 25 percent.

18. The golf ball of claim 15, wherein Wrap ranges about 10 percent and 100 percent.

19. The golf ball of claim 15, further comprising a marking orthogonal to the sighting aid that is representative of the plurality of characters in the sighting aid.

* * * * *